United States Patent [19]

Ramsey

[11] 4,051,970

[45] Oct. 4, 1977

[54] LIFT TRUCK LOAD HANDLING MAST

[75] Inventor: Keith E. Ramsey, Pleasant Lake, Mich.

[73] Assignee: K-D Manufacturing Company, Waco, Tex.

[21] Appl. No.: 630,039

[22] Filed: Nov. 7, 1975

[51] Int. Cl.[2] ..... B66F 9/06; B66F 9/08

[52] U.S. Cl. ..... 214/670; 187/9 E

[58] Field of Search ..... 187/9 R, 9 E, 95; 214/95 A, 670, 660, 730, 750, 671-674

[56] References Cited

U.S. PATENT DOCUMENTS

| | | | |
|---|---|---|---|
| 3,252,545 | 5/1966 | Quayle | 187/9 E |
| 3,462,028 | 8/1969 | Pi | 214/95 R |
| 3,715,014 | 2/1973 | Ohta | 187/9 E |
| 3,786,902 | 1/1974 | Ramsey | 187/9 E |

*Primary Examiner*—Robert J. Spar
*Assistant Examiner*—Carl Rowold
*Attorney, Agent, or Firm*—H. Mathews Garland

[57] ABSTRACT

A load handling mast for lift trucks including an extensible assembly of three rail sections nested together and interconnected by load supporting chains and a hydraulic rising piston and cylinder ram mounted on the middle rail section. The chains are reeved over sheaves mounted on the ram piston rod and the rail sections to provide a four to one ratio of mast extension relative to piston rod extension. The full extension and retraction of the mast and the support of the load manipulated by the mast is effected entirely through the chains and hydraulic ram without the use of a latch system.

16 Claims, 27 Drawing Figures

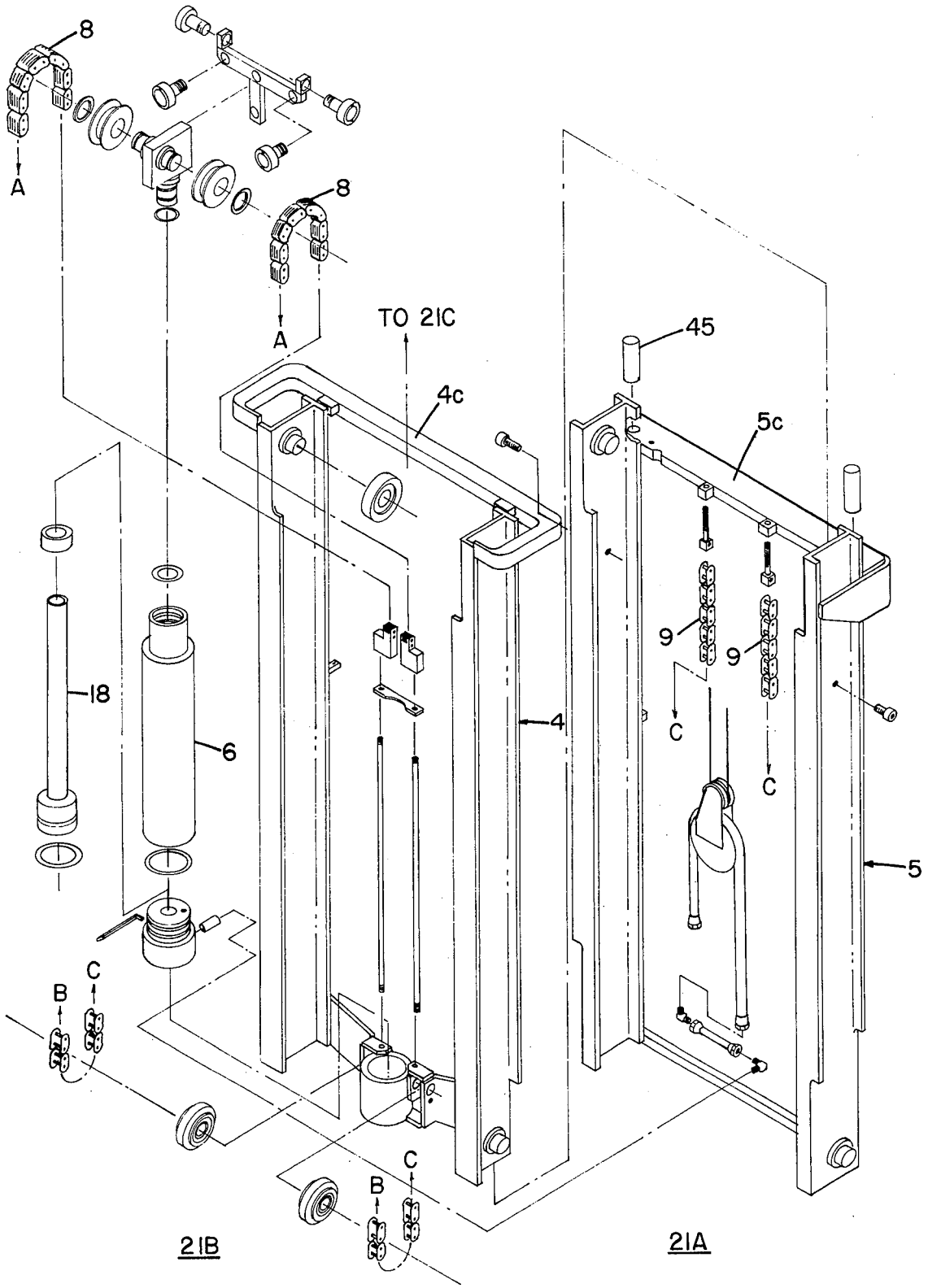
8
A
8
A
TO 21C
45
4c
5c
9
9
18
6
4
C
C
5
C
B
C
B
21B
21A

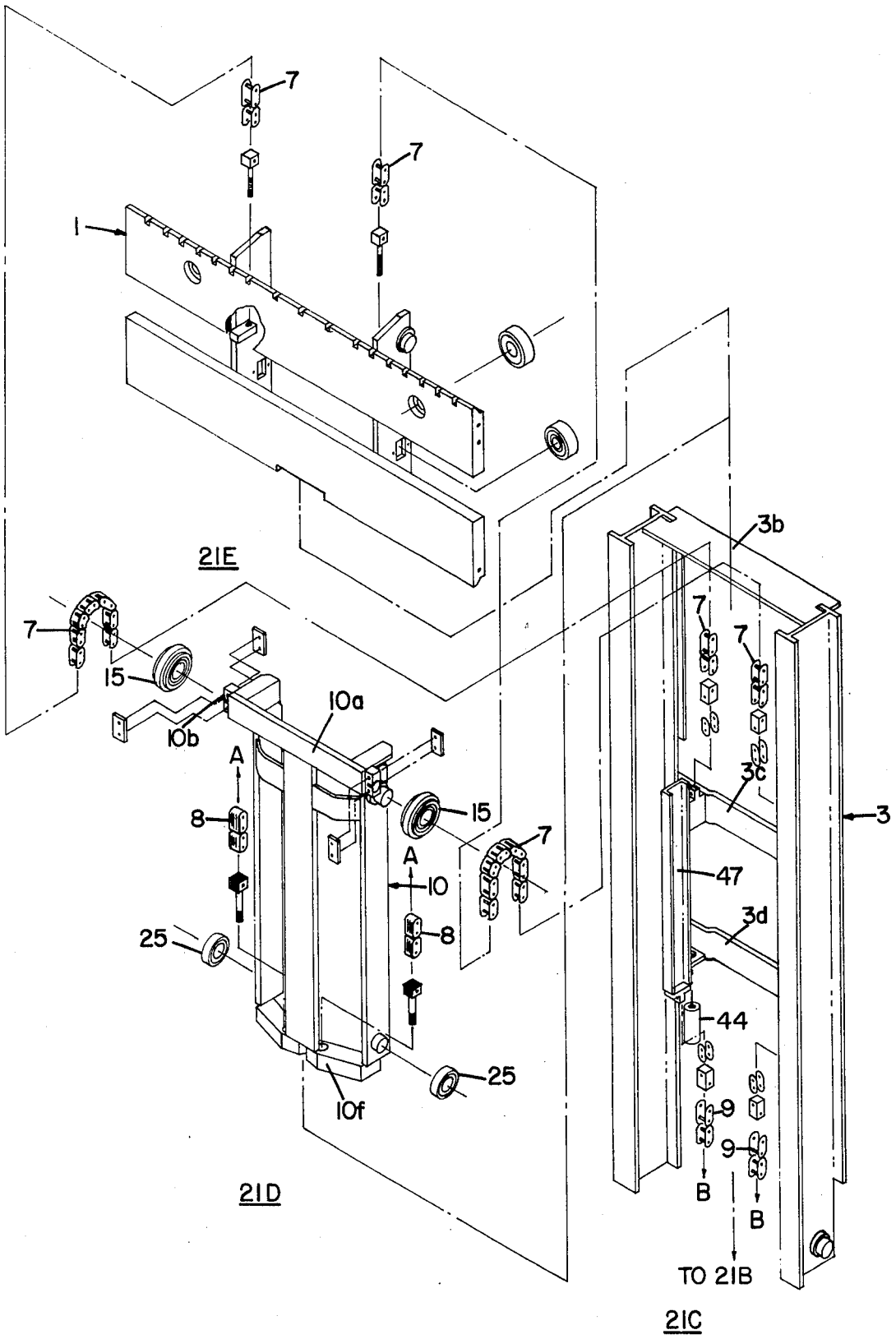
7
7
1
21E
7
15
10b
10a
A
8
15
7
A
10
8
25
25
10f
21D
3b
7
7
3c
3
47
3d
44
9
9
B
B
TO 21B
21C

LIFT TRUCK LOAD HANDLING MAST

This invention relates to load handling lift trucks and more particularly relates to an extensible mast assembly for use on such trucks to manipulate loads handled by the trucks.

Lift truck masts have been in use for a number of years in many different forms. Among the principal problems characteristic of currently available lift truck masts is erratic or rough and sometimes dangerous operation during the extension and retraction of the mast due to the use of latches or interlocking escapements which transfer the loads on the mast between the several rail sections as the mast is extended and retracted. Such latch arrangements cause dangerous impulses in the lifting and lowering motion of the mast preventing smooth raising and lowering of loads. Other problems inherent in existing mast assemblies include excessive interference with vision at certain stages in the operation of the mast, exposure of the hydraulic ram to damage when the mast is extended, erratic sequencing requiring sequencing latches, a chain reeving and latch arrangements used preclude desired cross bracing of rail sections, the use of the rail sections themselves as load supporting structures, and the requirement that the hydraulic ram used be rigidly mounted thereby making necessary certain manufacturing tolerances which increase costs and difficulties in assembly and adjustment. Other problems encountered with existing lift truck masts include limitation to a 3 to 1 ratio where a rising cylinder has been used or the necessity to use a multiple stage hydraulic ram. It has been found that where a 3 to 1 ratio is employed, a full free lift cannot be obtained unless a compound cylinder is used.

It is a particularly important object of the invention to provide a new and improved lift truck mast.

It is another object of the invention to provide a lift truck mast which does not use latches or escapements for load transfer as the mast is raised and lowered.

It is another object of the invention to provide a mast for a lift truck which achieves a 4 to 1 ratio in extension and retraction of the mast assembly relative to the movement of the piston of the hydraulic ram used to power the mast.

It is another object of the invention to provide a lift truck mast which utilizes a simple single stage hydraulic ram mounted in such a way that there is space above the cylinder of the ram for a full free lift stroke and a window for vision when the ram is lowered.

It is another object of the invention to provide a lift truck mast which utilizes only chains as the continuously lifting mechanism.

It is another object of the invention to provide a lift truck mast which permits the hydraulic ram and the only slide used to be rearward of the rail faces thereby reducing the possibility of damage.

It is another object of the invention to provide a lift truck mast which utilizes a hydraulic ram wherein the cylinder is pivotally mounted at a lower end with the upper end of the piston rod guided along the upper half of the inner rail assembly thereby providing substantially improved cylinder location control.

It is another object of the invention to provide a lift truck mast which will sequence in a normal manner due to absolute load support and stops to force the slides into proper position thereby obviating the need for sequencing latches.

It is another object of the invention to provide a lift truck mast which does not require a restraining escapement on the inner rail due to the fact that the lifting force on the inner rail assembly from a chain anchor is counteracted by an opposing chain force.

It is another object of the invention to provide a lift truck mast wherein the chain reeving permits intermediate cross bracing of the rail assemblies to give better control of the rail alignment and resists carriage spreading forces on the inner rail assembly.

It is another object of the invention to provide chain reeving with the chain roller slide guided in the inner rail assembly where it does not interfere with cross bracing and can be used as the inner rail lifting element above the free lift travel.

It is another object of the invention to provide a lift truck mast with the hydraulic ram cylinder supported on a chain anchored near the top of the outer rail assembly leaving the bottom free of load supporting members where space is at a premium.

It is another object of the invention to provide a chain reeving arrangement in a lift truck mast which transfers chain loads directly to the hydraulic ram cylinder rather than through inner rail assemblies.

It is another object of the invention to provide a lift truck mast wherein the inner rail is held downwardly without the use of latches by the weight of the carriage, the inner rail, the carrier, and the hydraulic ram and related structure which resists the lifting of the inner rail as the carriage moves through the free lift.

It is another object of the invention to provide a lift truck mast utilizing a rising hydraulic ram supported to provided a 4 to 1 ratio between the extension of the piston of the ram and the extension of the mast in lifting loads.

It is another object of the invention to provide a lift truck mast in which sequencing takes place without the transfer of loads between the several rail sections through the means of latches.

It is another object of the invention to provide a lift truck mast utilizing a set of three nested rail sections wherein the center or inner rail section serves only as a guide and a stabilizing member and is not a load bearing member.

It is another object of the invention to provide a lift truck mast using three nested rail portions wherein only the outer lower rail portion is a load bearing member.

It is another object of the invention to provide a lift truck mast wherein the secondary chain stops traveling at the upper end of the free lift sequence.

It is another object of the invention to provide a lift truck mast wherein the hydraulic ram is arranged in the middle rail section wherein it is protected against damage and is lifted upwardly as the mast is extended thereby removing it from floor level obstructions.

It is another object of the invention to provide a lift truck mast wherein a rising hydraulic ram mounted in the middle rail section is lifted to a level at full mast extension which provides a wide open window giving maximum visibility through only the bottom outer rail.

It is another object of the invention to provide a lift truck mast wherein the hydraulic ram is pivotally secured at a lower end thereof thereby providing a free floating cylinder arrangement which requires minimum manufacturing tolerances.

It is another object of the invention to provide a lift truck mast utilizing a free floating hydraulic ram which produces minimum lateral loads on the piston rod of the ram.

In accordance with the invention there is provided an extensible mast for a lift truck which includes an assembly of three nested rail sections each formed of parallel laterally spaced rails interconnected with a hydraulic ram for extending the mast and an arrangement of chains and sheaves which provide constant load support for extension and retraction of the mast without the necessity of transferring vertical loads between rail sections as the mast is raised and lowered. The hydraulic rail is pivotally mounted at a lower end on a cross member at the lower end of the middle rail section. A set of primary lift chains are connected at a first fixed end to the center rail section, extend upwardly over a pair of sheaves mounted on the upper end of the piston rod of the hydraulic ram, and extend downwardly from the sheaves to a carrier assembly which is raised and lowered by extension and retraction of the ram piston. A set of secondary lift chains are connected at first fixed ends with carrier guides on the inner rail section, extend upwardly over sheaves on the carrier assembly, and extend downwardly to a traveling end which is connected with a carriage having forks thereon for supporting the load manipulated by the lift truck. A set of tertiary lift chains is connected at a fixed end with the carrier guides on the inner rail section, run downwardly around sheaves on the lower end of the center rail section, and extend upwardly and are secured at upper ends thereof with the upper end of the bottom or outer rail section. The first sequence in the operation of extending the mast is the free lift of the load supporting carriage which occurs during initial extension of the hydraulic ram piston upwardly to raise the carriage to an upper end position along the inner rail section without upward extension of any of the rail sections. The initial upward extension of the piston ram raises the sheaves supporting the primary lift chain causing upward movement of the carrier assembly at a rate twice that of the extension of the piston. As the carrier assembly is raised relative to the inner rail, the sheaves over which the secondary lift chains run are raised with the carrier assembly lifting the carriage at a 2 to 1 ratio relative to the upward movement of the carrier assembly. The carriage moves upwardly at a 4 to 1 ratio relative to the extension of the ram piston until the upper end of the carrier assembly engages the inner rail. Thereafter extension of the ram piston lifts the carrier assembly which raises the inner rail pulling the tertiary chains upwardly causing a lifting of the center or middle rail section. A 4 to 1 ratio continues in the upward extension of the mast based on the upward movement of the ram piston. The hydraulic ram rises with the upward movement of the middle rail section which supports the ram assembly. In an alternate embodiment of the mast the secondary lift chains are made unitary with the tertiary lift chains providing the same 4 to 1 extension of the mast without the use of sequencing latches.

The foregoing objects and advantages of the invention will be better understood from the following detailed description of the preferred embodiments thereof taken in conjunction with the accompanying drawing wherein.

Figure 13A:
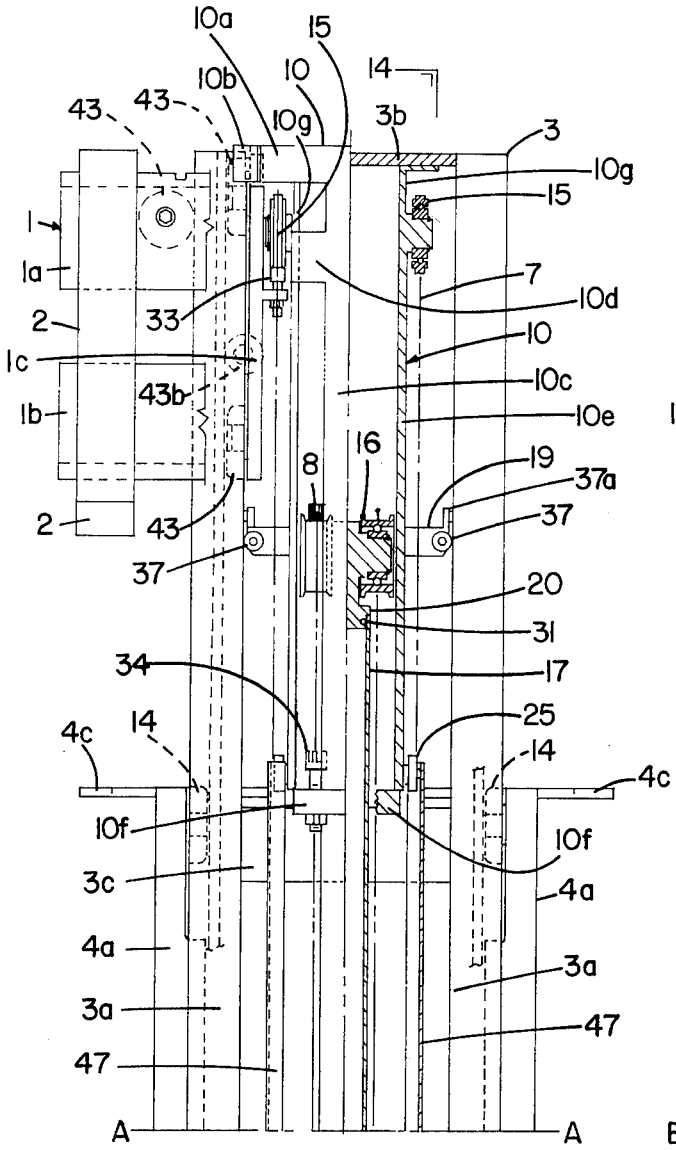
Figure 14A:
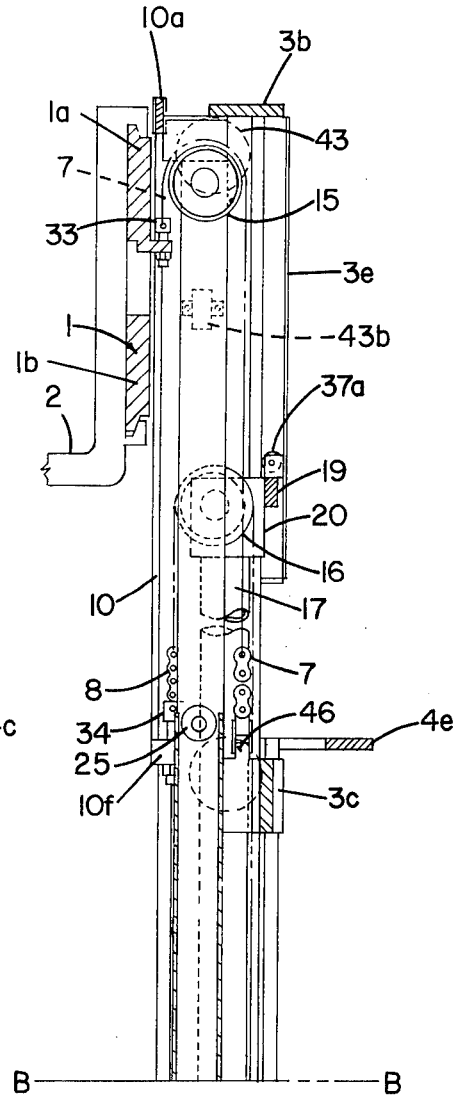
Figure 13B:
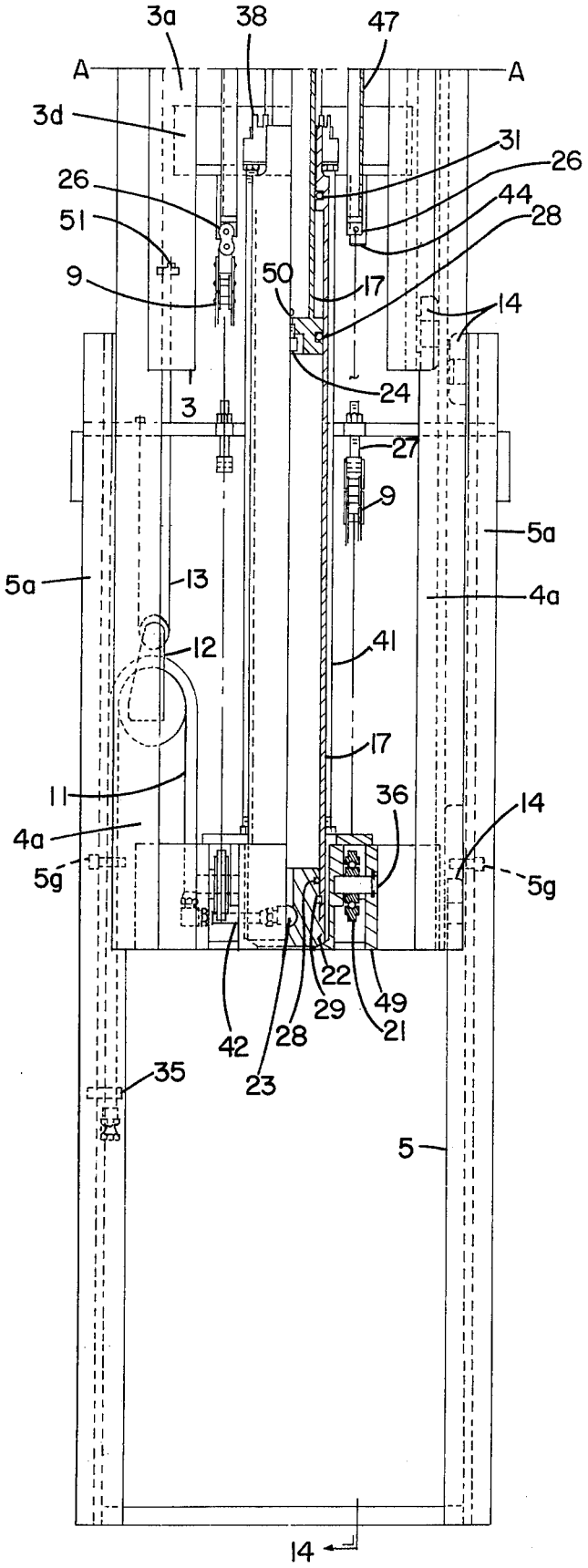
Figure 14B:
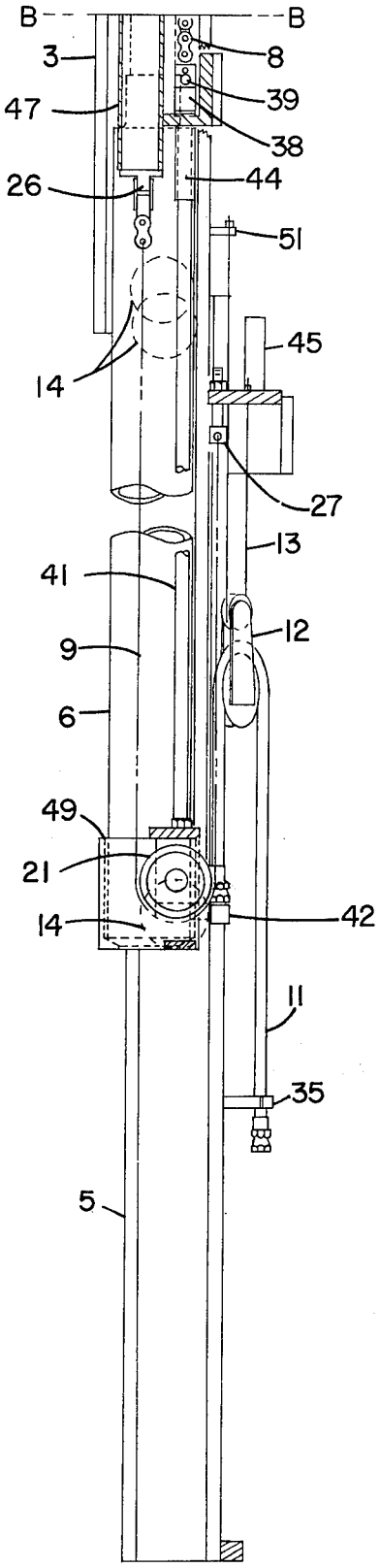
Figure 15:
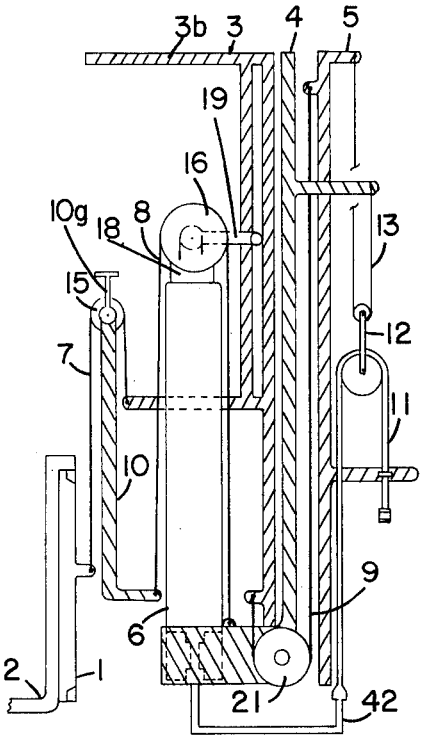
Figure 16:
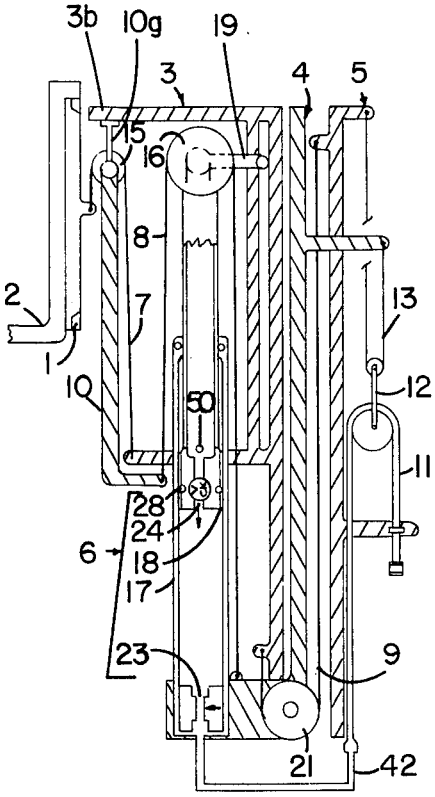
Figure 17:
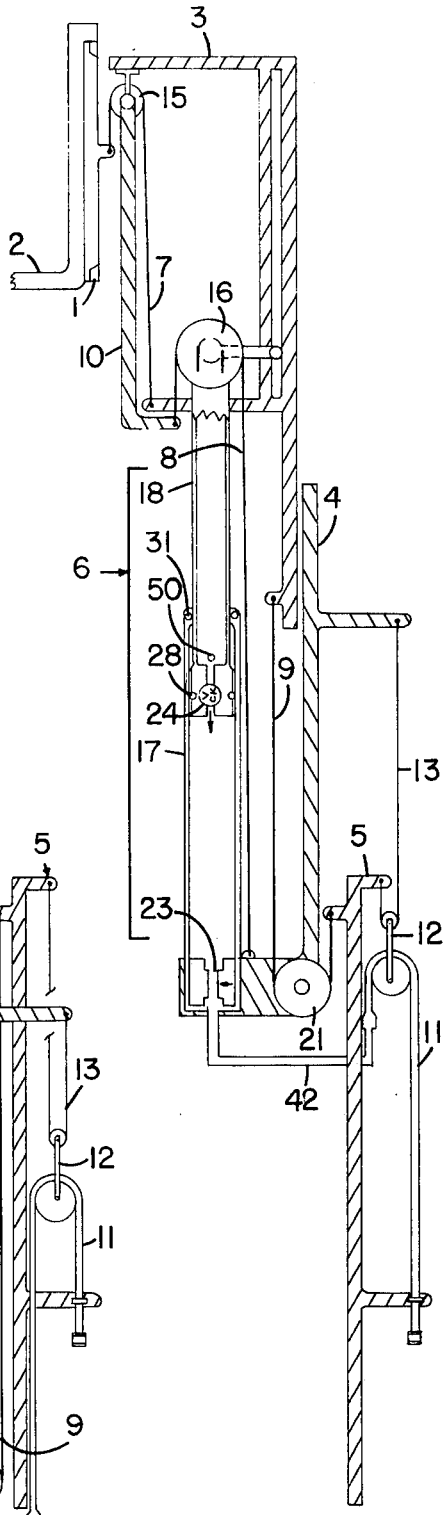
Figure 18:
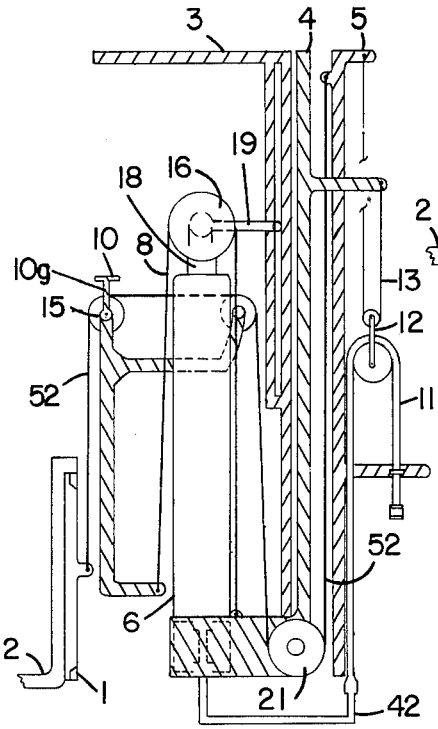
Figure 19:
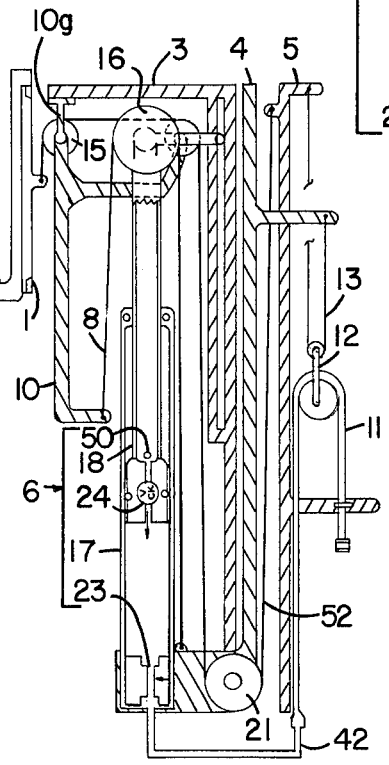
Figure 20:
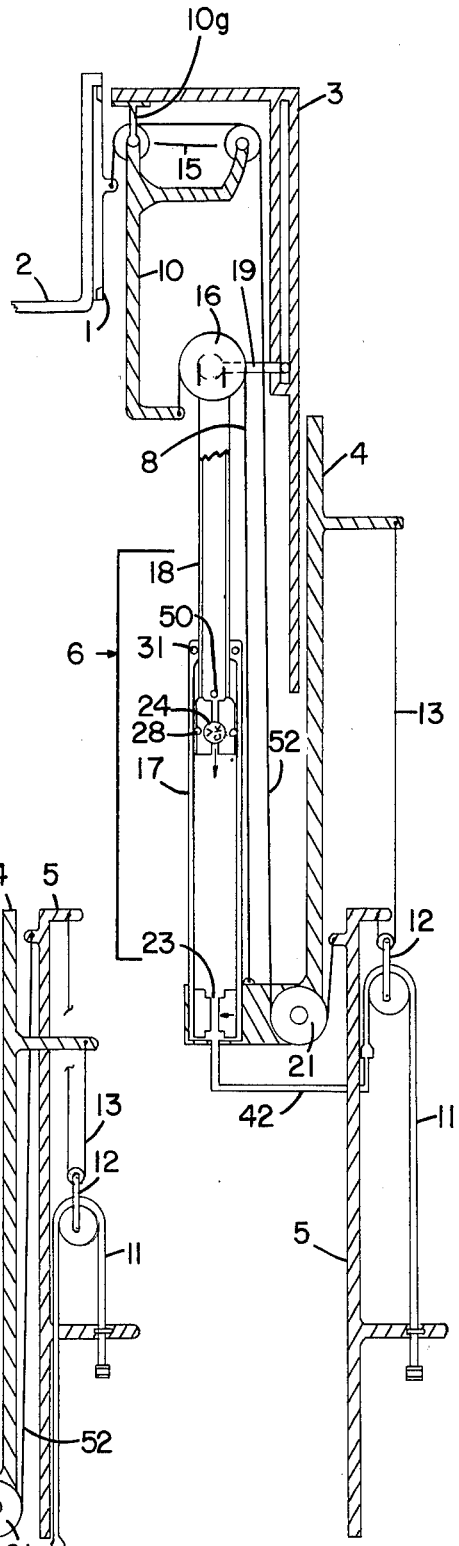

FIGS. 13A and 13B taken together constitute a front view in elevation and section of the mast fully extended;

FIGS. 14A and 14B taken together constitute a side view in section and elevation of the extended mast as seen along the line 14—14 of FIGS. 13A and 13B;

FIG. 15 is a schematic side view of one embodiment of the mast fully collapsed illustrating the three rail sections, the hydraulic ram, the carrier assembly, the carriage, and the interconnecting chains;

FIG. 16 is a schematic view of the embodiment of the mast shown in FIG. 15 with the carriage at maximum free lift elevation;

FIG. 17 is a schematic view of the form of the mast shown in FIGS. 15 and 16 fully extended;

FIG. 18 is a schematic view of an alternate embodiment of the mast wherein the secondary and tertiary lift chains are integral;

FIG. 19 is a schematic view of the embodiment of the mast as shown in FIG. 18 with the carriage at maximum free lift; and FIG. 20 is a schematic view of the mast form shown in FIGS. 18 and 19 fully extended.

FIGS. 21A–21E taken together are an exploded perspective view of the mast of the invention;

FIG. 21A shows the inner rail assembly and fragments of the upper ends of the tertiary lift chains secured to the rail assembly;

FIG. 21B shows the center rail assembly with the hydraulic ram assembly with fragments of the primary lift chains;

FIG. 21C shows the inner rail assembly with the carrier assembly guide channels and fragments of the tertiary lift chains and the secondary lift chains.

FIG. 21D shows the carrier assembly with fragments of the primary and secondary lift chains; and FIG. 21E shows the carriage assembly with fragments of the secondary lift chains.

Figure 1:
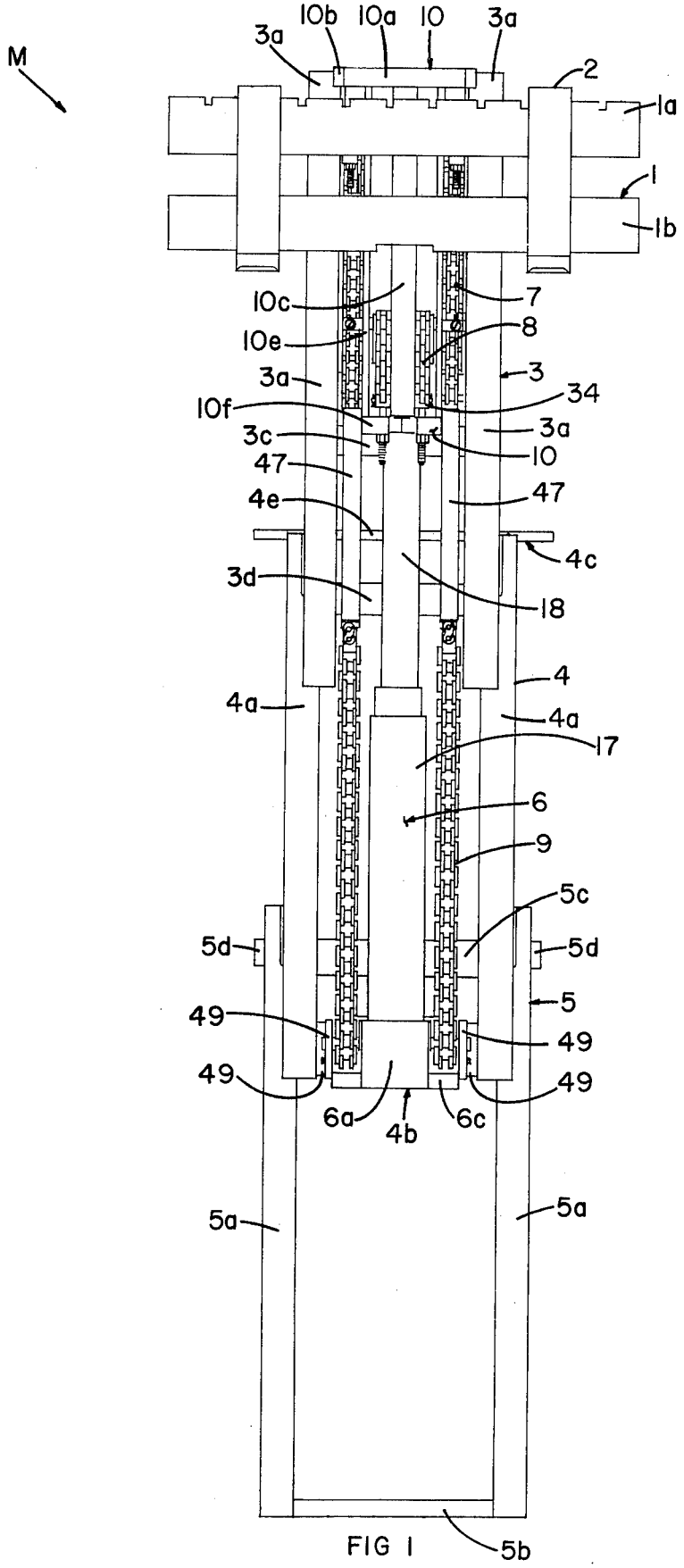
FIG. 1 is a front view in elevation of an extended mast incorporating the features of the invention.

Referring to FIG. 1 of the drawings a lift truck mast M comprises a carriage assembly 1 supporting a set of load handling forks 2 and movable along an inner rail assembly 3 which slides within a center rail assembly 4 which is movable within an outer rail assembly 5. The mast is extended and collapsed by means of a hydraulic ram assembly 6 pivotally mounted at a lower end within the center rail assembly 4. The carriage 1 is supported from a set of secondary lift chains 7 which are connected at a fixed end with the inner rail assembly and at a traveling end with the carriage. A carrier assembly 10 supports the secondary lift chains and is movable along the inner rail assembly suspended from a set of primary lift chains 8 which are secured at a fixed end with the center rail assembly, extend over sheaves 16 mounted on the piston rod of the ram assembly 6 and are secured at a traveling end with the carrier assembly 10. The inner rail assembly 3 is connected with the center rail assembly 4 by means of a set of tertiary lift chains 9 which are connected at a fixed end with the upper end of the outer rail assembly 5, extend downwardly around a set of sheaves 21 at the lower end of the center rail assembly 4 and are connected at a traveling end with the inner rail assembly 3. The carriage, carrier assembly, and the inner and center rail assemblies are all suspended by the three sets of chains at all times to provide a continuous free lift of the carriage and full extension of the mast at a 4 to 1 ratio relative to extension of the ram piston without the use of latches between the carriage and the rail assemblies. The first steps in the sequence of the free lift of the carriage and the extension of the mast are illustrated schematically in FIGS. 15 and 16. The hydraulic ram assembly 6 is actuated extending the piston upwardly raising the sheaves 16 on the upper end of the piston lifting the primary lift chains 8 which raises the carrier assembly 10 at twice the rate that the piston rod extends upwardly. As the carrier assembly 10 is raised the secondary lift chains 7 lift the carriage 1 with the forks 2 at a 2 to 1 ratio relative to the upward movement of the carrier assembly with the net effect being a 4 to 1 ratio in the upward movement of the carriage relative to the upward extension of the piston rod. The carrier assembly and carriage move upwardly until the upper end of the carrier assembly 10 engages the inner rail assembly 3 at which time the inner rail assembly is picked up by the carrier assembly. Continued upward extension of the piston raises the inner rail assembly by means of the primary lift chains which are lifting the carrier assembly. As the inner rail assembly is then lifted the traveling ends of the tertiary lift chains are raised causing the center rail assembly 4 to be extended upwardly from the position shown in FIG. 16 to that of FIG. 17 which shows the mast fully extended. Throughout the several sequences of upward movement of various portions of the mast as represented in FIGS. 15, 16, and 17 continuous upward movement at a 4 to 1 ratio relative to the extension of the hydraulic ram piston is achieved due to the novel arrangement of the hydraulic ram assembly 6 and the reeving of the sets of chains. As the center rail assembly is raised, the hydraulic ram assembly moves upwardly as evident in FIG. 17. The reverse sequence as will be explained in more detail hereinafter occurs during the collapse of the mast to return it from the position of FIG. 17 to that of FIG. 15. A bleed back of the hydraulic pressure in the ram assembly permits controlled return of the mast to the fully collapsed condition of FIG. 15.

Figure 4:
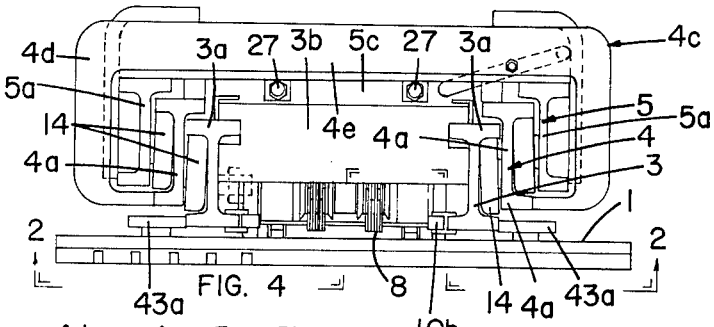
FIG. 4 is a top view of the collapsed mast as illustrated in FIG. 2.
Figure 3:
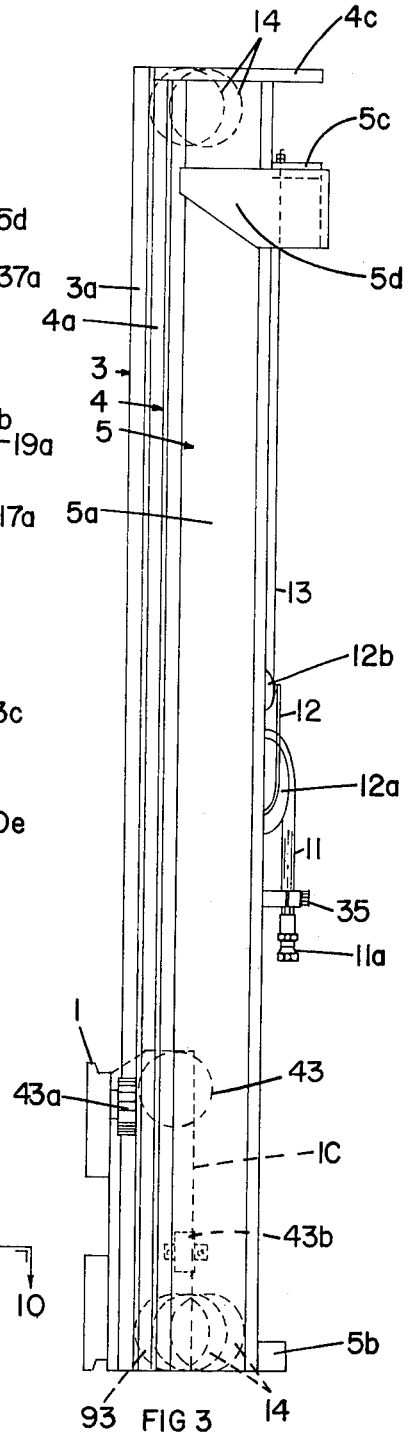
FIG. 3 is a side view in elevation of the collapsed mast shown in FIG. 2.
Figure 5:
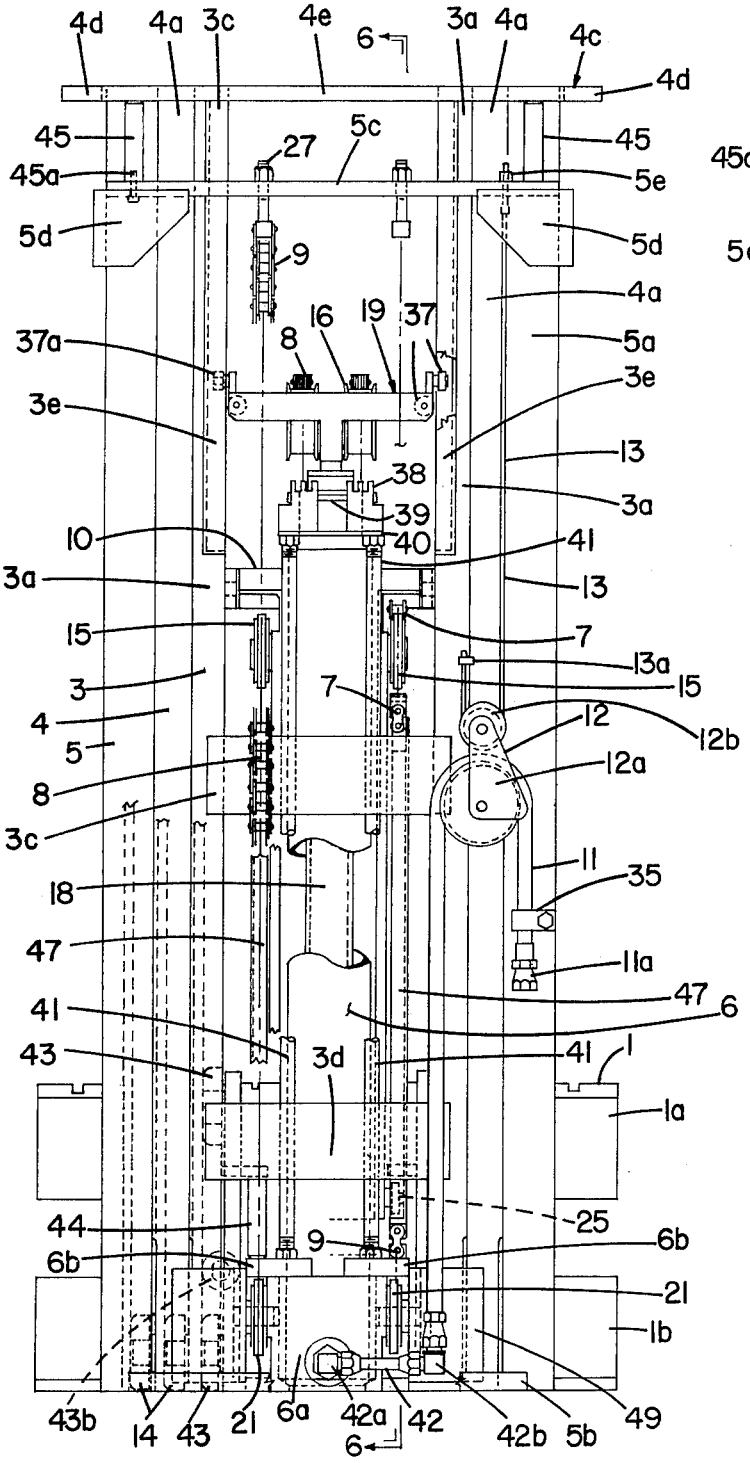
FIG. 5 is a back view in elevation and partially broken away of the collapsed mast as seen in FIG. 2.

The outer rail assembly 5 includes a pair of identical laterally spaced parallel rails **5*a* each of which has an I cross section as best seen in FIG. 4. The rails 5*a* are secured together at bottom ends by a cross member 5*b* and near the upper ends thereof by a cross member 5*c* connected between the rails and at opposite ends to brackets 5*d* each of which is an L-shaped member in horizontal cross section having a side portion fitting down the outside of each of the rails 5*a* as shown in FIG. 3 and across the back face of each of the rails overlapping the center rails as represented in FIG. 5. The cross member 5*c* is secured with the brackets 5*d* on the outer rails. A pair of upwardly extending cylindrical stops 45 are secured at a bottom end by a bolt 45*a* to the top face of the outer rail cross member 5*c* as evident in FIGS. 5 and 6 to provide a lower end for the center rail assembly 4 as discussed hereinafter. The outer rail assembly does not move upwardly and downwardly but rather is the fixed bottom rail assembly of the mast which is securable to a truck, not shown, which transports and operates the mast in a conventional manner. The mast bottom rail assembly 5** is connectible in any suitable desired manner with the truck such as is illustrated in my U.S. Pat. No. 3,786,902 issued Jan. 22, 1974 entitled LOAD-LIFTING MECHANISM FOR A LIFT TRUCK. As described in such patent, the mast may be mounted with the truck in such a manner as will permit some slight tilting of the mast from a vertical position.

The center rail assembly 4 is formed by a pair of laterally spaced parallel I-shaped rails **4*a* which are secured together at the lower ends of the rails by a horizontal hydraulic ram support assembly 4*b* and at the upper ends of the rails by a wrap-around stop flange 4*c* which has C-shaped end portions 4*d* and an integral straight cross portion 4*e*. The end portions 4*d* extend around the outer faces of the outer rails 5*a* connecting with the forward outside flange of the center rails 4*a*. The cross member portion 4*e* of the bracket extends across the back faces of all three sets of outer, center, and inner rails. The bracket member 4*c* serves the dual purpose of connecting together the upper ends of the center rails and serves as a lower end stop for the center rail assembly as evident in FIGS. 5 and 6 which shows that the upper end faces of the stop members 45 are engaged by the bottom face of the member 4*c*** supporting the center rail assembly at a lower end position.

Figure 6:
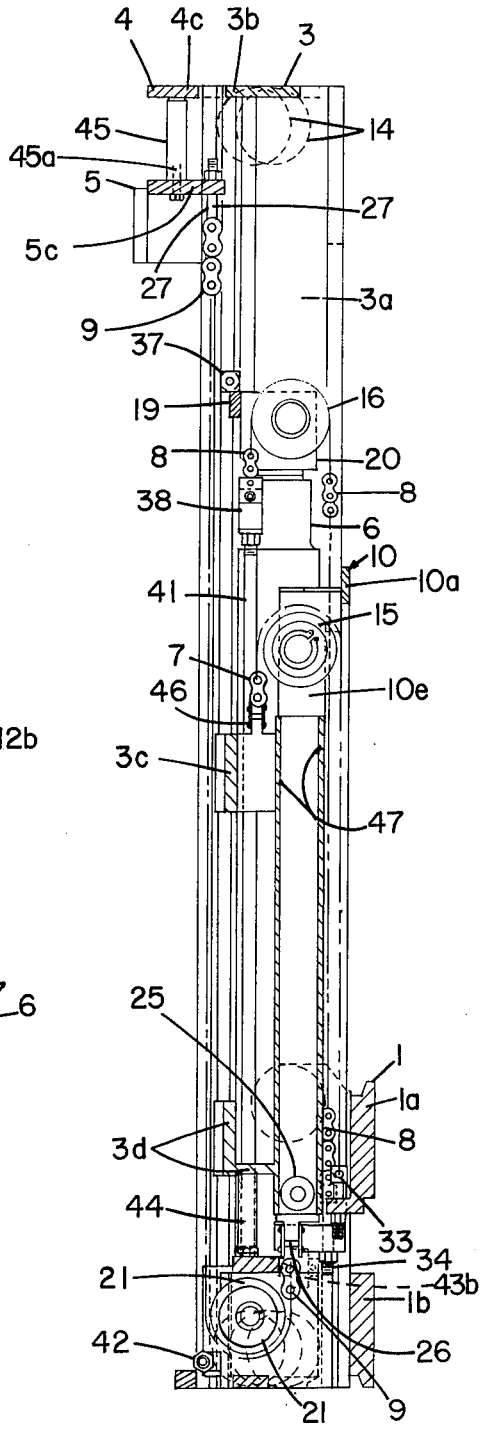
FIG. 6 is a side view in section and elevation of the collapsed mast as seen in FIG. 5 viewed along the line 6—6 of FIG. 5.
Figure 7:
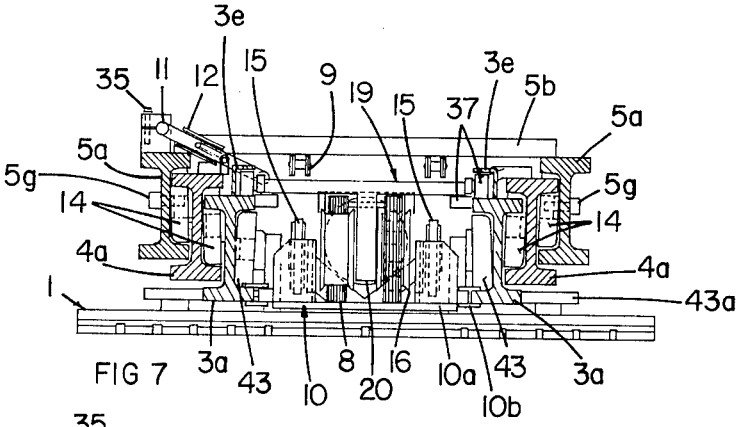
FIG. 7 is a view in section and elevation along the line 7—7 of FIG. 2.
Figure 8:
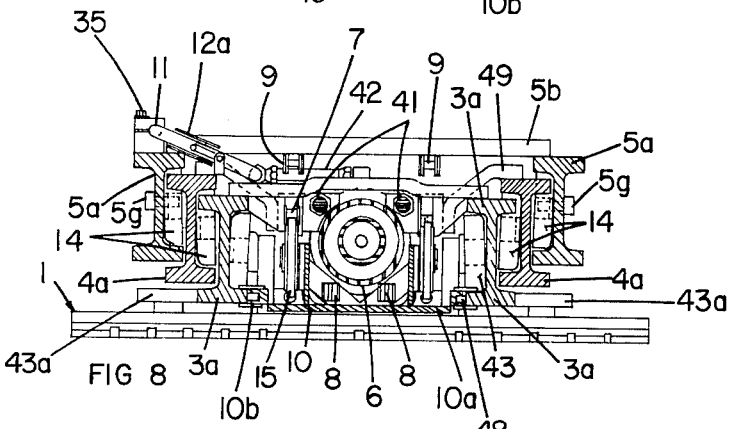
FIG. 8 is a view in section and elevation taken along the line 8—8 of FIG. 2.

The inner rail assembly 3 is formed by laterally spaced parallel I-shaped rails **3*a* which are secured together at upper ends by a transverse top plate 3*b* and down the back faces of the rails by a middle horizontal cross member 3*c* and a lower horizontal cross member 3*d*. The member 3*b* also serves as a lift surface for raising the inner rail assembly upon engagement by the upper end of the carrier assembly 10. Along the back face of each of the rails 3*a* as shown in FIG. 5 aligned with the inside edge of each of the rails is a vertical guide channel 3*e* which functions to stabilize and guide the upper end of the hydraulic ram piston as it extends upwardly and downwardly in lifting and collapsing the mast. The guide channels 3*e* as illustrated in FIG. 7 are formed in cross section in the shape of a conventional angle member which will retain guide rollers as explained in further detail hereinafter. Secured with the bottom edge of the lower cross member 3*d* on the inner rail assembly are a pair of laterally spaced downwardly projecting stops 44 which limit the downward movement of the inner rail assembly to a lower end position as represented in FIG. 5. The stops 44 may be seen in FIGS. 5, 6, and 13B. The lower ends of the stops come to rest on the top of the cross assembly 4*b* between the lower ends of the center rails 4*a*. A pair of channel shaped guide tracks 47 are secured in parallel laterally spaced relationship within the guide rails 3*a* connected with the inside forward faces of the horizontal guide rail braces 3*c* and 3*d* as shown in FIG. 6** providing a guide for the lower end of the carrier assembly and a longitudinal coupling member between the secondary and tertiary lift chains.

Figure 2:
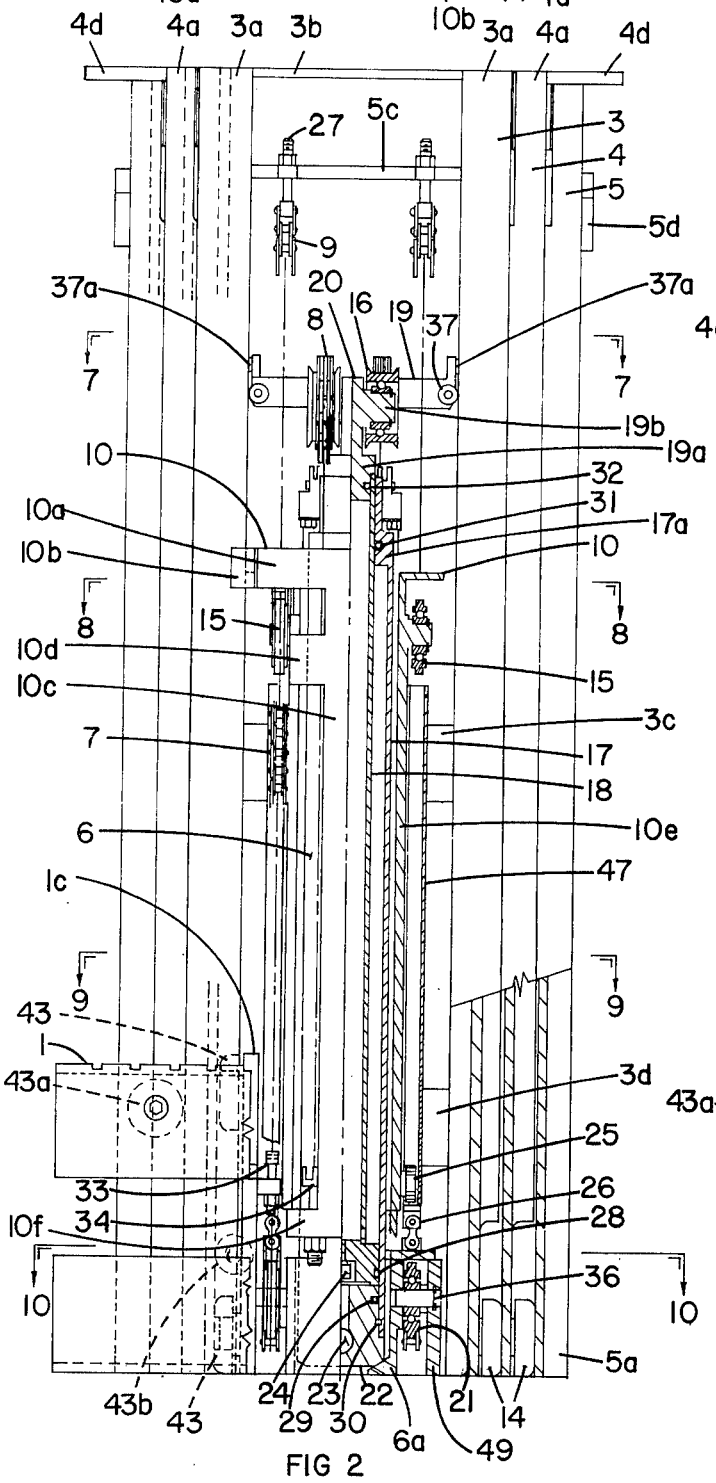
FIG. 2 is a front view in elevation and section of the mast shown in FIG. 1 in the collapsed or retracted condition.
Figure 9:
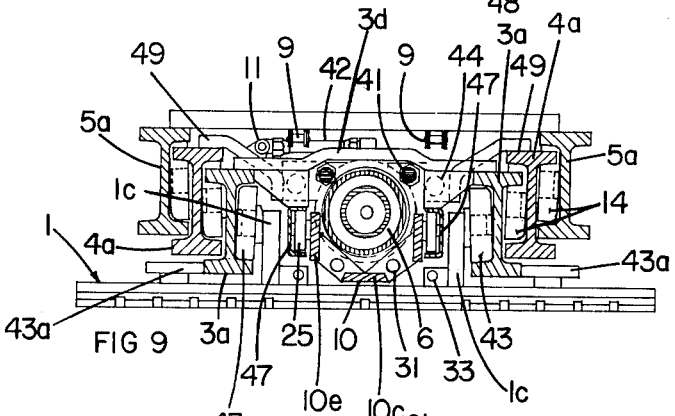
FIG. 9 is a view in section and elevation taken along the line 9—9 of FIG. 2.
Figure 10:
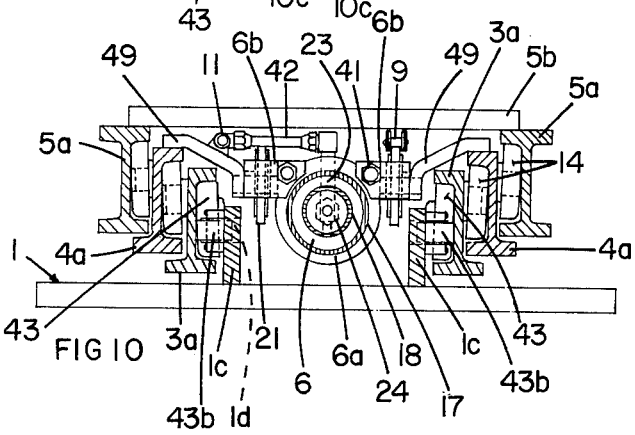
FIG. 10 is a view in section and elevation taken along the line 10—10 of FIG. 2.

As evident particularly from the cross sectional views as shown in FIGS. 4, and 7 – 10, the inner, center, and outer rail assemblies are nested together to permit telescopic extension and collapse of the mast as desired for raising and lowering loads being supported on the forks 2. The center rail assembly slides within the outer rail assembly while the inner rail assembly slides within the center rail assembly. Guide rollers are used to facilitate this sliding movement at the upper and lower ends of the rail assemblies. As illustrated in FIG. 4 showing the upper end of the mast when collapsed a guide roller 14 is secured on a shaft along the inside face of the upper end of each of the rails 5*a* rolling within the outer channel face of the adjacent center rail 4*a*. Similarly, a guide roller 14 is secured on a shaft along the inside face of the upper end of each of the guide rails 4*a* rolling within the outside channel face of the adjacent inner rail 3*a*. Similarly, the lower ends of the rails are provided with rollers to facilitate movement of the rail assemblies for extension and collapse of the mast. The lower end of FIG. 2 and FIG. 10 illustrates the mounting of the lower sets of guide rollers 14. The lower ends of the center rail 4*a* are each provided with a roller 14 which rides within the inside channel face of the outer rails 5*a*. Similarly, the lower ends of the inner rails 3*a* are each provided with a roller 14 mounted to ride within the inside channel face of the center rails 4*a*. Thus, the upper ends of the rails 5*a* are each provided with a roller 14 while the lower ends of each of the center rails 4*a* has a roller 14 thereby providing for movement of the center rail assembly within the outer rail assembly. Similarly, the upper ends of each of the center rails 4*a* has a roller 14 while the lower ends of each of the inner rails 3*a* has a roller 14 providing for the movement of of the inner rail assembly within the center rail assembly. The rollers 14 as evident in FIGS. 4 and 10 are canted in directions to provide for both lateral and forward loading of the rails inasmuch as the prevailing load conditions tend to tilt the mast forward away from the lift truck. Forward would be the direction toward the carriage or downwardly as viewed in FIG. 4. It will be noted that the rollers 14 in FIG. 4 are canted outwardly toward the carriage so that the back corners of the rollers fit within the back corners of the outside channels of the respective rails to provide loading the back flanges of each of the rails with the corner position of the back inside edges of each of the rollers engaging the outer face of the channel and forward face of the flange on each of the rails so that lateral loads and forward loads are compensated for by the roller engagement with the rails. Similarly, in FIG. 10 the rollers 14 are canted inwardly toward the forward side of the mast as these rollers are carried by the lower ends of the respective rails which tend to be forced backwardly toward the lift truck due to turning moments on the upper ends of the rails applied by the load being carried on the forks. This also provides inside back corner loading along each of the rail inside faces and forward flange faces to compensate for the prevailing forward loading on the mast. It will be noted in FIG. 4 that the rollers 14 mounted in the upper ends of each of the center rails 4*a* have a forward portion which projects through a recess in the forward inside flange of each of the rails 4*a* so that the rollers may engage the inside face of the forward flange on each of the inner rails 3*a*. Similarly, at the lower ends of the rails as viewed in FIG. 10 the guide rollers 14 are canted to position the back edges of the rollers within the back corners of the rails 4*a* and 5*a* respectively to provide lateral and forward loading against the inside faces of the rail channels and the forward faces of the rail flanges due to the fact that the lower ends of the rails 3*a* and 4*a* tend to be urged rearwardly responsive to forward loading on the mast. There is a slight amount of tolerance between the diameters of the guide rollers and the forward and aft spacing of the guide rail flanges which will be taken up with loading against the forward flanges in the event that the mast should lean backwardly toward the truck. As previously stated, however, this is an unusual condition as the prevailing operating condition results in the mast leaning slightly forwardly particularly in view of the position of loads on the fork supported by the mast.

The carriage assembly 1 is formed by upper horizontal rail 1*a* and a lower horizontal rail 1*b* which support the forks 2. The carrier members 1*a* and 1*b* are mounted on vertical laterally spaced plates 1*c*, FIGS. 3 and 10 which are secured perpendicular to and along the back faces of the members 1*a* and 1*b* spaced to fit within the inside faces of the inner rails 3*a*. Each of the vertical members 1*c* is provided with upper and lower rollers 43 secured on lateral shafts extending outwardly from the members 1*c* positioning the rollers within the inside channels of the inner rails 3*a*. Also, a roller 43*b* is mounted in a window 1*d* of each carriage member 1*c* on a fore and aft axis above the lower rollers 43 to engage the inside face of the web of each rail 3*a* to cooperate with the rollers 43*a* in resisting twisting forces on the carriage. The lower guide rollers on the carriage vertical members 1*c* as seen in FIG. 10 load the back flanges of the inside rails 3*a* while the upper guide rollers of the carriage as seen in FIG. 9 load the forward flanges of the inner rails 3*a* as the result of the natural turning tendency downwardly on the carriage due to a load on the forks. Mounted on the back face of the upper carriage member 1*a* are an additional pair of guide rollers 43*a* which roll along the outer flange edges of the forward flanges of the inner rails 3*a*. The rollers 43*a* are each mounted on an eccentric cam which permits adjustment of the lateral spacing between the rollers so that they can be moved closely along the outer flange edges of the inner rails.

Figure 12:
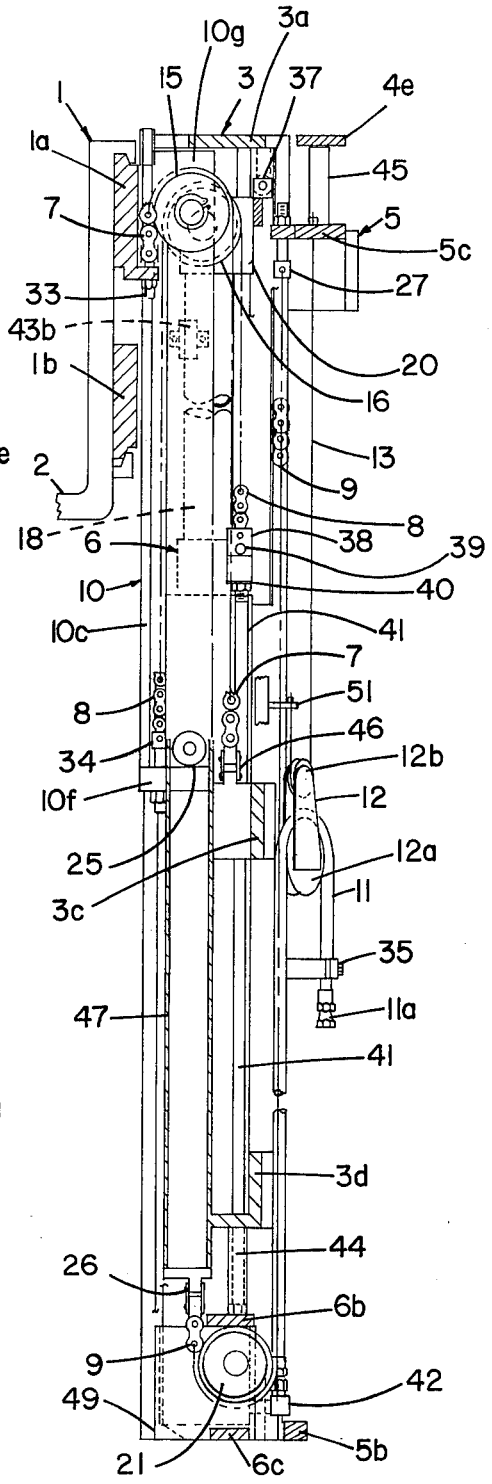
FIG. 12 is a side view in section and elevation of the mast as seen in FIG. 11.

The carriage 1 is suspended from the traveling ends of the secondary lift chains 7 by securing the lift chain traveling ends with anchors 33 to the upper cross member 1*a* of the carriage as shown in FIG. 12. Each of the chains 7 extends upwardly over a carrier sheave 15 mounted in laterally spaced relationship on a shaft on the carrier assembly 10 which is an elongated assembly positioned vertically along the front face of the mast between the inner rails 3*a*. The carrier assembly has an upper cross member 10*a* the lateral outer ends of which are each provided a channel shaped guide 10*b* which rides along the inside edge of the front flanges of the inner rails 3*a*. Each of the guide channels 10*b* has a wear button 48 which actually slides in contact with the adjacent edge of the inner rail flange for guiding the carrier as it moves vertically between the inner rails during the free lift of the carriage. The carrier assembly has a central vertical elongated plate portion 10*c* which extends a substantial length of the inner rail assembly as evident in FIG. 2. The carrier 10 also has a horizontal member portion 10*d* which is bend in a U-shape as seen in horizontal cross section joining vertical portions 10*e* of the carrier which extend the length of the front portion 10c in planes perpendicular to the front portion thereby providing a vertical framework which fits around the hydraulic ram assembly 6. The carrier sheaves 15 are mounted on the shafts which extend laterally outwardly on the carrier assembly vertical side portions 10e below the top horizontal cross member 10a of the carrier assembly. The secondary lift chains 7 are reeved over the carrier sheaves 15 and extend downwardly where the fixed or nontraveling ends of the chains 7 are each anchored to the upper end of the adjacent carrier assembly guide channel 47 as viewed in FIG. 12. Thus, as the carrier is lifted the carrier assembly sheaves 15 move upwardly raising the secondary chains 7 which raise the carriage 1.

The lower end of the carrier assembly 10 is provided with a bottom plate portion 10f which is formed integral with the lower ends of the vertical front portion 10c and the vertical side portions 10e of the carrier. The plate portion 10f is a generally U-shaped member which fits around the hydraulic ram assembly. The lower ends of the primary chains 8 are secured by anchors 34 with the lower plate portion 10f at the lower end of the carrier assembly 10. The primary chains extend upwardly within the open framework of the carrier assembly forward of the hydraulic ram assembly within the carrier assembly side plates 10e behind the front plate 10c of the carrier assembly frame to a pair of sheaves 16 mounted on the upper end of the hydraulic ram piston 18. The primary lift chains then extend downwardly over the sheaves 16 along the ram assembly where the fixed ends of the chains 8 are secured to chain anchors 38 at the head of the ram cylinder 18. The anchors 38 are mounted on the upper ends of tie rods 41 which extend downwardly along the hydraulic ram cylinder 18 connecting into the base assembly 4b other center rail assembly 4 so that the load on the chains 8 is imposed on the tie rods to the base end of the center rails rather than to the ram cylinder. Coupling blocks 40 are mounted on the upper ends of the tie rods 41 through which a connecting rod 39 is inserted for coupling the fixed ends of the chains 8 to the chain anchors 38 on the coupling blocks. The sheaves 8 are mounted on opposite sides of a cross frame guide assembly 19 secured on the upper end of the piston rod 18 as best seen in FIG. 2. The guide assembly 19 has a closure head 19a which fits within the upper end of the piston rod and is sealed by a ring seal 32 with the piston rod. A second ring seal 31 fits within a cylinder head 17a at the upper end of the hydraulic ram cylinder 17. The head 19a has a cross shaft 19b on which the sheaves 16 are mounted for the primary lift chains 8. Since the fixed ends of the primary lift chains 8 are secured at the cylinder base through the tie rods 41, upward extension of the piston rod 18 lifts the sheaves 16 causing the traveling ends of the chains 8 which are connected with the carrier base plate 10f to lift the carrier at a 2 to 1 ratio relative to the upward extension of the piston rod. The lower end of the carrier assembly along the outer faces of the side members 10e is provided with a pair of carrier roller guides 25, FIG. 2, which roll within the guide channels 47 mounted along the inner rails 3a. There are two roller guides 25 one on each of opposite sides of the carrier assembly to guide the lower end of the carrier assembly in a straight vertical line as directed by the channels 47.

The lower end of the hydraulic ram assembly is supported in the base assembly 4b of the center rails 4a. The base assembly 4b may be designated as a cradle assembly formed by a short cylindrical pen topped sleeve 6a into which the lower end of the cylinder 17 of the ram assembly loosely fits. The sleeve 6a is secured with integral upper and lower block portions 6b and 6c on opposite sides of the sleeve 6a which extend laterally to brackets 49 connected with the back faces of the lower ends of the inner rails 3a. The brackets 49 extend vertically the height of the sleeve 6a and are somewhat L-shaped as seen in FIG. 10. A pair of tertiary chain sheaves 21 is mounted in spaced relationship on opposite sides of the cylinder support sleeve 6a each supported on a shaft 36 extending between the sleeve 6a and the brackets 49.

The pair of tertiary chains 9 are connected at traveling ends each by an anchor 26 to the lower end of the carrier guide channel 47 which effectively couples the traveling ends of the tertiary chains with the inner rail assembly. The tertiary chains pass downwardly around the tertiary chain sheave 21 mounted within the base cradle assembly 4a of the middle rail assembly 4 and upwardly along the back face of the mast assembly to the cross brace 5c at the upper end of the back face of the outer rail assembly. The upper ends of the tertiary chains are connected by anchors 27 into the cross brace 5c as shown in FIG. 12. This arrangement of reeving the tertiary chain over from the inner rail assembly downwardly around the sheaves 21 on the center rail assembly and upwardly to the fixed points on the outer rail assembly causes the center rail assembly to be lifted by the chains 9 as the inner rail assembly 3 is raised by upward extension of the piston rod 18. A 2 to 1 ratio is obtained between the extension of the piston rod and the lifting of the inner rail assembly and similarly a 2 to 1 ratio is obtained between the lifting of the inner rail assembly and the center rail assembly so that the net end result is a 4 to 1 ratio between the piston rod extension and the total extension of the mast after the end of the free lift.

The guide head assembly 19 at the upper end of the piston rod 18 holds the piston rod in both lateral and fore and aft alignment as the piston rod extends for raising the mast. As seen in FIGS. 2 and 7 the guide assembly 19 has a pair of laterally spaced guide rollers 37 which engage the adjacent inside faces of the flanges along the back side of the mast to maintain lateral alignment of the guide assembly as the piston rod moves upwardly and downwardly for extending and collapsing the mast. Similarly, the guide assembly has a pair of guide rollers 37a mounted on shafts at 90° angles to the rollers 37 and running in the vertical guide channels 3e along the back faces of the inner rails 3a as particularly evident in FIG. 5 to maintain the fore and aft alignment of the guide head assembly as the piston rod moves upwardly and downwardly.

As shown in FIG. 5, the hydraulic ram assembly is supplied with hydraulic fluid through a tube 42 connected by a fitting 42a into the lower end of the cylinder assembly. The tube 42 is connected by an L-shaped fitting 42b into a flexible hose 11 which operates over a hose sling assembly 12 having a sheave 12a for the hydraulic hose. A fixed end of the hose is strapped by a bracket or clamp 35 to the back face of one of the outer rails 5a. A coupling 11a is provided for connection into a source of hydraulic pressure, not shown, which may comprise a hydraulic pump on the lift truck on which the mast is mounted. A suspension cable 13 is connected at an upper fixed end with the cross member 5c of the outer rail assembly 5. A traveling end 13a of the cable 13 is connected with the back face of the adjacent middle rail 4a so that as the middle rail rises lifting the hydraulic ram assembly, the hose sling assembly 12 is lifted to maintain the hydraulic hose 11 taut as the ram base and the end of the hose at the fitting 42b move upwardly. The sheave 12b along with the sheave 12a move upwardly simultaneously so that the hydraulic hose feeds upwardly and over the sheave 12a while the cable 13 feeds downwardly around the sheave 12b. In this manner the hydraulic hose is always kept neatly along the back face of the mast without any tendency to become entangled in the operating mechanism of the mast maintaining it clear of any possible damage which would effect the supply of hydraulic fluid to the ram assembly.

The base end of the hydraulic ram assembly 6 has a flow control valve 23 which is a pressure compensated flow control permitting free flow into the piston but in the event of damage to the hydraulic supply line such as breakage of the line the flow control devices works in the nature of a check valve which will permit fluid to exhaust from the piston slowly enough that the mast will collapse at a safe rate. The base end of the piston rod 18 is provided with a vent hole 50 opening between the interior of the rod and the cavity of the cylinder around the rod. A check valve 24 is provided in the base end of the piston rod.

In operation the mast M is suitably secured by connecting the base end of the outer rail section 5 along the back sides of the rails 5a with a lift truck such as described and illustrated in my previously referred to U.S. Pat. No. 3,786,902. The coupling 11a connected with the hydraulic line 11 on the mast is secured with the hydraulic system of the lift truck to supply hydraulic fluid under pressure to the hydraulic ram 6 of the mast. For handling a load the mast is initially fully collapsed as illustrated in FIGS. 2 and 5 for picking up a load on the forks 2 at floor or ground level along the surface of which the lift truck is maneuvering. The horizontal portions of the forks 2 are inserted beneath the load to be handled. Hydraulic fluid pressure is then applied through the hydraulic line 11 into the base end of the cylinder 17 of the hydraulic ram assembly 6. The fluid pressure is applied to the lower end of the piston 24a on the lower end of the piston rod 18 lifting the piston rod forcing extension of the rod upwardly. As the piston rod moves upwardly, the sheaves 16 on the upper end of the piston rod are raised. The hydraulic ram assembly 6 is cradled at a lower end in the sleeve 6a supported by the lower cross member 4a of the center rail assembly 4. Thus as the piston rod extends upwardly it is moving relative to the center rail assembly. The fixed ends of the primary lift chains 8 are secured through the anchors 38 and the tie rods 41 with the hydraulic ram base. The traveling ends of the primary lift chains 8 are secured with the lower horizontal plate portion 10f at the lower end of the carrier assembly 10. Thus as the upwardly moving piston lifts the sheaves 16 the traveling end of the primary lift chains 8 is raised at a rate twice that of the upward movement of the piston rod. The carrier assembly 10 is therefore moved upwardly within the inner rail assembly 3 during the free lift sequence. The upper end of the piston rod 18 is guided by the assembly 19 which carries the rollers 37 for lateral alignment of the piston rod and the rollers 37a for fore and aft alignment of the upwardly moving piston rod. As the carrier assembly is raised the upper end of the carrier assembly at the cross member 10a is guided by the channel guides 10b which slide along the inside edges of the forward inside flanges on the inner rails 3a. The lower end of the carrier assembly 10 is guided by the rollers 25 which move within the vertical guide channels 47 secured with the cross members 3c and 3d of the inner rail assembly 3.

Figure 11:
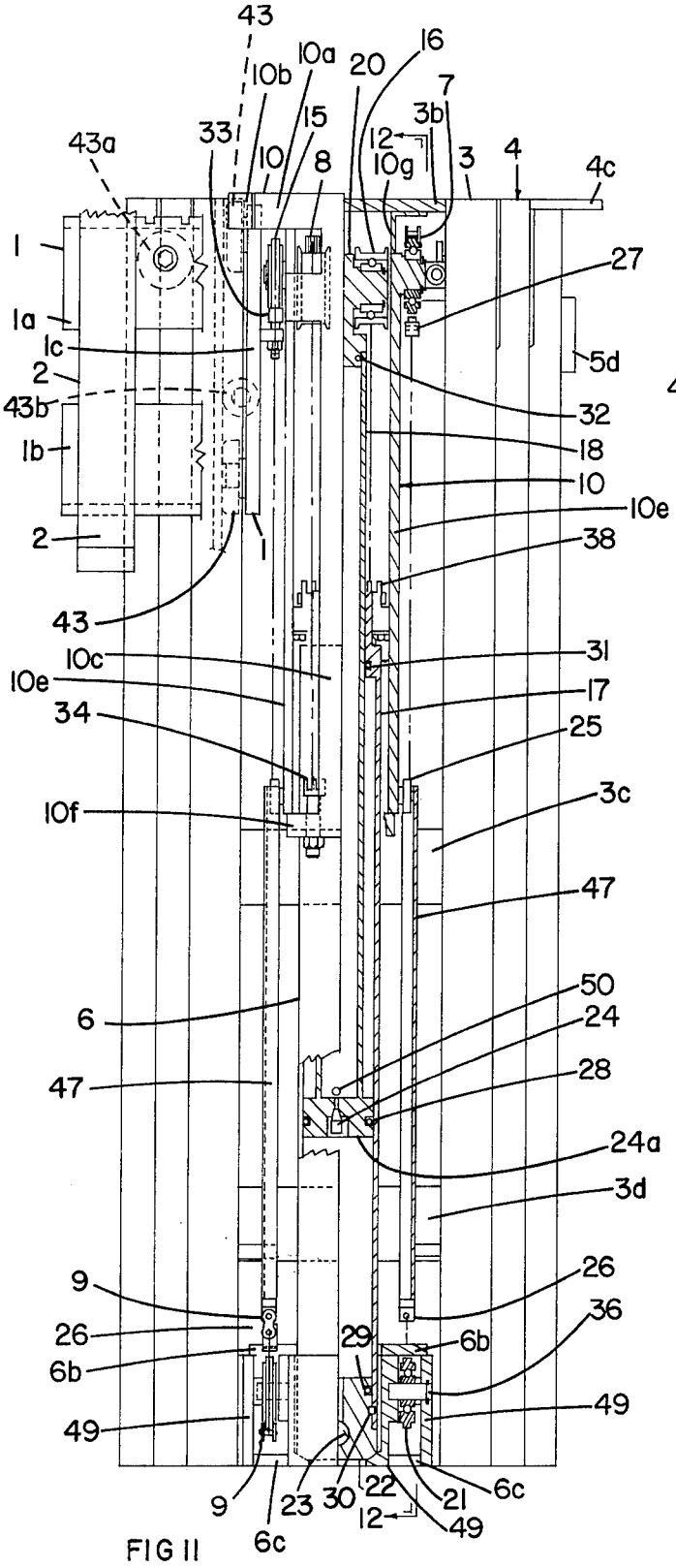
FIG. 11 is a front view in elevation and section of the collapsed mast with the carrier assembly and carriage raised to the maximum free lift position preliminary to upward extension of the rail sections.

The upwardly moving carrier assembly 10 lifts the carrier assembly supported secondary chains sheaves 15 which are mounted on the side portion 10e of the carrier assembly slightly above and behind the cross member 10d of the carrier assembly. The secondary lift chains 7 are reeved over the sheaves 15 running from fixed ends secured with the upper ends of the channels 47 along the inside of the inner rail assembly, as seen in FIG. 6, to the traveling ends which are secured at the back inside face of the carriage cross member 1a. Thus, the chain sheaves 15 are lifted by the carrier assembly relative to the inner rail assembly raising the carriage supporting the forks 2 lifting the carriage with the load being handled upwardly relative to the carrier assembly at a 2 to 1 ratio based on the upward movement of the carrier assembly. The upwardly moving piston rod 18 therefore raises the carriage at a rate which is four times that of the upward movement of the piston rod. The carrier assembly 10 moves upwardly relative to the inner rail assembly 3 until the upper ends 10g of the carrier assembly above the sheaves 15 engage the bottom face of the inner rail top cross member 3b at which time the carrier assembly 10 ceases upward movement relative to the inner rail assembly. This particular step at the upper end of the free lift sequence is illustrated in FIG. 16. Since the upward movement of the carrier assembly 10 relative to the inner rail assembly 3 terminates at this point, the carriage 1 with forks 2 is at the upper end of travel of the free lift sequence which is illustrated in the detailed drawings in FIGS. 11 and 12. From this step on in the full extension of the mast the carrier assembly 10 does not move upwardly relative to the inner rail assembly 3, but rather the carrier assembly lifts the inner rail assembly 3 and therefore the secondary lift chains 7 and the carrier sheaves 15 supporting the secondary lift chains become immobile holding the carriage 1 at the upper end of the carrier assembly 10 and the inner rail assembly 3.

The next sequence in the upward extension of the mast M involves the simultaneous upward movement of the inner rail assembly 3 and the center rail assembly 4 from the positions shown in FIG. 16 to the fully extended positions of FIG. 17 which are also represented in detail in FIGS. 13A and 13B and 14A and 14B. At the completion of the free lift sequence, the piston rod 18 of the hydraulic ram assembly 6 is only partially extended upwardly. Thus, at the completion of the free lift continued hydraulic pressure into the ram assembly continues to force the piston rod 17 upwardly. After the upward extension of the piston rod to effect the carriage free lift, the ends of the primary lift chains 8 secured with the carrier assembly 10 at the assembly plate 10f continue as the traveling ends of the primary lift chain as the piston rod 18 continues extending upwardly. The fixed ends of the primary lift chains 8 at the base of the hydraulic ram assembly continue as effective fixed ends relative to the upwardly moving piston so that as the carrier assembly 20 lifts the inner rail assembly 3 the primary lift chains 8 travel in a clockwise direction as viewed in FIG. 16, the upward movement of the inner rail assembly 3 raising the carrier assembly guide channels 47 which are connected with the cross members of the inner rail assembly which in turns pulls upwardly the traveling end of the tertiary lift chains 9. As the traveling ends of the tertiary lift chains are pulled upwardly the chains travel around and below the tertiary chain sheaves 21 which are secured at the lower end of the middle rail assembly 4 on opposite sides of the base of the hydraulic ram assembly 6. The middle rail assembly 4 is therefore lifted by the tertiary lift chains 9 so that the middle rail assembly moves upwardly. The fixed ends of the tertiary lift chains 9 are secured with the upper cross member 5c of the outer rail assembly so that only those ends of the tertiary lift chains 9 connected with the inner rail assembly may travel upwardly. This upward extension of the piston rod relative to the center rail assembly causes the inner rail assembly along with the carrier assembly and the carriage to move upwardly at a ratio of 2 to 1 relative to the upward movement of the piston rod. Thus the primary lift chains and the tertiary lift chains are moving producing a 4 to 1 upward movement of the carriage relative to the upward extension of the piston rod. The simultaneous upward movement of the inner rail assembly and the center rail assembly continues until the mast is fully extended as seen in FIGS. 17 and 13A and 13B along with FIGS. 14A and 14B.

The total effect of the upward extension of the piston rod from the beginning of the free lift sequence through the completion of the full extension of the mast produces a 4 to 1 ratio between the movement of the carriage and the upward movement of the piston rod. During the initial phases of the operation during the free lift the upward movement of the sheaves 16 on the piston rod produces a 2 to 1 ratio in the upward movement of the carrier assembly 10 which raises the sheaves 15, again producing another 2 to 1 ratio in the upward movement of the carriage 1 so that the 4 to 1 ratio results during the free lift. A different relationship exists, however, beyond the free lift but one which still produces a total 4 to 1 ratio. When the carrier assembly 10 picks up the inner rail assembly 3, the continued upward movement of the sheaves 16 lifting the primary chains 8 produces a 2 to 1 upward movement of the inner rail assembly 3 along with the carrier assembly 10 and the carriage 1 which are moving upwardly as a unit so that they do move upwardly two units for each one unit of upward movement of the piston rod. Since the upward movement of these components as a unit pulls one end of the tertiary chain 9 upwardly, there is produced a 1 to 1 ratio between the upward movement of the inner rail assembly 3 and the center rail assembly 4 so that for each single unit of upward movement of the center rail assembly 4 the inner rail assembly 3 moves upwardly one unit away from the center rail assembly 4. Therefore, the end result is still a 4 to 1 ratio relative to the piston movement since one unit movement of the piston rod produces two units of movement of the inner rail assembly and the two units of movement of the inner rail assembly lifts the center rail assembly two units at a 1 to 1 ratio but with a total net result of four units of movement of the upper end of the inner rail assembly and carriage for each one unit of upward extension of the piston rod.

Locking lugs 5g secured through the web portions of the outer rails 5a project into the inside channel portions of the rails interfering with the lower rollers 14 at the lower ends of the center rails 4a limiting the upward movment of the center rails within the outer rails, thereby stopping the mast at the upper extended position as represented in FIG. 1 and FIGS. 13a, 13b, 14a, and 14b.

The mast is collapsed by releasing the hydraulic fluid pressure in the ram assembly 6 to permit the weight of the load and the weight of the various components of the mast to drop back downwardly. Suitable fluid flow controls are provided, not shown, to permit a desired bleed-off of the hydraulic pressure to permit the ram piston 17 to move back downwardly. The collapse of the mast produces the reverse sequence described in connection with the extension of the mast. The center and inner rails move back downwardly simultaneously at a 4 to 1 ratio relative to the downward movement of the piston rod. The carrier assembly 10 and the carriage remain in the positions relative to the inner rail assembly 3 as represented in FIG. 17 until both the center rail assembly 4 and the inner rail assembly 3 are fully collapsed downwardly to the positions of FIG. 16. Thereafter the carrier assembly 10 and the carriage 1 move back downwardly from the upper end to the lower end of the free lift sequence. More specifically, referring to FIG. 17, as the piston rod 18 retracts the sheaves 16 are lowered causing the primary lift chains to feed in a counterclockwise direction over the sheaves lowering the inner rail assembly 3. The downward movement of the inner rail assembly feeds the tertiary lift chains 9 downwardly in a clockwise direction around the lower sides of the sheaves 21, thereby permitting the center rail assembly to be lowered. When both the inner and center rail assemblies are lowered to the positions of FIG. 16, continued retraction of the piston rod 18 feeds both the secondary lift chains 7 and the primary lift chains 8 in a counterclockwise direction over the sheaves 15 and 16, respectively, simultaneously lowering the carrier assembly 10 relative to the inner rail assembly and the carriage 1 relative to the carrier assembly until the free lift sequence is completed with the forks 2 and the carriage 1 at the lower end of the free lift returned to floor level.

Throughout the extension and collapse of the mast the carriage 1, the carrier assembly 10, the inner rail assembly 3, and the center rail assembly 4 are all supported by the chains without the use of interconnecting latches. The pickup of the inner rail assembly and the center rail assembly are each accomplished without the necessity of latches. Basically the vertical loads are carried by the chain and hydraulic ram system, not by the rail assemblies. The only one of the rail assemblies which carries compressive loads is the outer fixed bottom rail assembly. The center and inner rail assemblies are basically guide members which also carry forward and backward bending moments but not the vertical compressive forces resulting from the load being handled. With the unique arrangement of sheave location and chain reeving neither the center rails nor the inner rails carry the load on the mast so that these loads do not tend to distort the rails and interfere with the telescoping action of the rails. Additionally by relieving the rails of the loads the bracing arrangement permits improved vision for the operator. Another advantage in the chain reeving arrangement is that the tertiary chain is connected in such a manner with the lower end portion of the inner rail that the chains tends to hold the inner rail down as the carriage moves upwardly through the free lift. As previously indicated this eliminates the necessity for the use of a latch to accomplish this function. The only load bearing member of the rail assembly is the outer rail assembly which is not required to move but rather remains fixed as the bottom rails connected with the lift truck. It will be noted particularly from FIG. 1 and FIG. 13B that by using the rising hydraulic ram system with the system mounted in the middle rail, when the mast is fully extended the space between the outer bottom rails is totally unobstructed so that maximum vision is provided to the lift truck operator. This is especially advantageous as the handling of a load at full mast extension is an especially critical and sometimes dangerous stage in a lift truck operation. In addition to permitting maximum vision to the operator the removal of the hydraulic ram system upwardly as the mast extends puts the hydraulic system in a less vulnerable position for damage as the lift truck is maneuvered. Another feature of the chain reeving employed is a natural tendency to sequence in the correct order in the extension and collapse of the mast. Because of the manner in which the loads are supported through the chains, sequencing in proper order is of less consequence as it really is of no significance if the inner rail should tend to come up ahead of time during the extension of the mast.

An alternate arrangement of chain reeving is illustrated in FIGS. 18, 19, and 20 wherein the secondary lift chains 7 and the tertiary lift chains 9 are replaced by a single continuous set of lift chains 52 which extend from the carriage 1 over sheaves on the carrier assembly 10, downwardly around the sheaves 21 on the center rail assembly, and upwardly to the fixed anchor points at the upper end of the outer rails of the rail assembly 5. It will be recalled that in the form of the mast illustrated in FIGS. 1–17 the secondary lift chains 7 were connected at one end of the guide channels 47 while the tertiary lift chains 9 were connected at the other end of the guide channels which is the equivalent of the alternate embodiment of simply making the secondary and tertiary chains integral with the replacement of the chains by the continuous chain 52. With such an arrangement the mast sequences in the same order as when separate secondary and tertiary chain sets are used. Referring to FIG. 18 the free lift of the alternate form of mast is effected by extending the hydraulic ram piston 18 upwardly lifting the sheaves 16 relative to the center rail assembly 4. The primary lift chains raise the carrier assembly 10 as the sheaves 16 move upwardly. As the carrier assembly moves upwardly the weight of the center and inner rail systems on the chain 52 together with the weight of the load on the forks tends to hold the center and inner rail assemblies downwardly while the primary lift chains 8 raise the carrier assembly 10 causing the chains 52 to feed over the sheaves 15 lifting the carriage 1 upwardly. When the upper end of the free lift sequence is reached, as shown in FIG. 19, the upper end of the carrier assembly 10 engages the inner rail assembly 3 lifting the inner rail assembly along with the carriage and carrier assembly as the piston rod is further extended upwardly. Further extension of the piston rod lifts the inner rail assembly relative to the center rail assembly pulling the lift chains 52 clockwise around the bottoms of the sheaves 21 raising the center rail assembly. This procedure continues until the mast is fully extended as shown in FIG. 20. Release of the hydraulic pressure permits collapse of the mast through the reverse procedure until it is fully retracted downwardly as shown in FIG. 18 and the carriage is at the lower end of the free lift. Other then the making of the secondary and tertiary chains continuous the form of the mast shown in FIGS. 18-20 is identical to that of FIGS. 1-17.

What is claimed is:

1. An extensible load handling mast for a lift truck comprising: a plurality of telescopic sections operably interconnected to extend and collapse including a first vertically fixed outer section, a second vertically movable center section, and a third vertically movable section; a load handling carriage movably mounted on a carrier assembly vertically movable along said third mast section, said third section comprising the top section of said mast when said mast is fully extended; a hydraulic ram comprising a single stage unit having a cylinder and one extendable piston rod operable in said cylinder, said ram being supported on said second mast section for vertical movement within said mast sections; and flexible line means movably supporting said carriage from said carrier at all positions of said carriage along said mast from a lowest position of said carriage at full retraction of said mast to a maximum height position of said carriage at full extension of said mast and said flexible line means operably interconnecting said mast sections and said carrier and carriage to produce a four-to-one ratio in the raising and lowering of said carriage relative to said extendible piston rod for extending and collapsing said mast and raising and lowering said carriage along said mast responsive to operation of said ram.

2. A mast for a lift truck in accordance with claim 1 wherein said carrier assembly is movably supported from said hydraulic ram piston rod.

3. A mast for a lift truck in accordance with claim 2 including sheave means on said carrier assembly, a flexible support means connected from said third inner mast section over said sheave means on said carrier assembly to said carriage, sheave means on the upper end of said piston of said hydraulic ram, flexible support means from said carrier assembly over said sheave means on said ram piston rod to said second center mast section, sheave means on said second center section of said mast, and flexible support means from said third inner section of said mast under said sheave means on said second center section of said mast extending to said first vertically fixed section of said mast.

4. A mast for a lift truck adapted to extend and collapse for supporting loads at a plurality of elevations and maneuvering said loads with said lift truck comprising: a first rail assembly adapted to be connected with said lift truck and remain fixed vertically; a second rail assembly coupled with and telescopically operable within said first rail assembly movable vetically relative to said first rail assembly; sheave means secured at a lower end of said second rail assembly; a third rail assembly telescopically operable within said second rail assembly and vertically movable relative to said second rail assembly; elongated flexible means secured at one end with said third rail assembly, extending beneath said sheave means on said second rail assembly and secured at a second opposite end with an upper end portion of said first rail assembly, said flexible means being adapted to raise and lower said second rail assembly within said first rail assembly responsive to vertical movement of said third rail assembly; a hydraulic ram supported on said second rail assembly, said ram having a single cylinder and a single extendible piston rod; sheave means on the upper free end of said piston rod; a carrier assembly mounted for vertical movement along said third inner rail assembly; elongated flexible means connected from said carrier assembly over said sheave means on said piston rod to said second rail assembly for raising and lowering said carrier assembly responsive to vertical movement of said piston rod; a carriage for supporting a load from said mast mounted for vertical movement along said carrier assembly; sheave means on said carrier assembly; and elongated flexible means connected from said carriage over said sheave means on said carrier assembly to said third rail assembly raising and lowering said carriage responsive to vertical movement of said carrier assembly.

5. A mast for a lift truck in accordance with claim 4 wherein said carrier assembly is engageable with said third rail assembly at an upper end position of said carrier assembly relative to said third rail assembly for lifting said third rail assembly responsive to continued upper extension of said piston rod.

6. A mast for a lift truck in accordance with claim 5 wherein said flexible means are each connected to provide a four to one lift ratio between the upward movement of said carriage and the extension of said piston rod from a bottom position of said carriage when said mast is fully collapsed to an upper end position of said carriage when said mast is fully extended, said carriage, carrier assembly, and rail assemblies being continuously supported by said flexible means at all carriage positions during extension and collapse of said mast and full free lift of said carriage between the lowermost and uppermost positions of said carriage.

7. An extensible and collapsable mast for a lift truck for handling loads with said truck comprising: a first outer rail assembly adapted to be secured with said lift truck and remain fixed vertically; a second center rail assembly telescopically engaged with said first rail assembly and adapted to move vertically relative to said first rail assembly; sheave means secured with the lower end portion of said second center rail assembly; hydraulic ram assembly means mounted on said second center rail assembly including an extendible piston rod; sheave means mounted on an upper end portion of said piston rod of said hydraulic ram assembly; a third inner rail assembly telescopically engaged with said second center rail assembly for vertical movement relative to said second center rail assembly; a carrier assembly mounted for vertical movement along said third inner rail assembly; sheave means mounted along an upper end portion of said carrier assembly; a carriage assembly mounted for vertical movement along said third inner rail assembly for supporting a load handled by said lift truck; flexible means connected at a first end with said carriage assembly and extending over said sheave means on said carrier assembly, under said sheave means on said second center rail assembly, and connected at a second opposite end with an upper portion of said first rail assembly for supporting said second center rail assembly from said first outer rail assembly and said carriage assembly from said carrier assembly and for raising and lowering said second and third rail assemblies and said carriage assembly; flexible means secured at a first end with a lower end portion of said carrier assembly, extending over said sheave means on said upper end portion of said hydraulic ram piston rod and connected at a second opposite end with said second center rail assembly; and means on said carrier assembly for engaging and supporting said third inner rail assembly by said carrier assembly for raising and lowering said third rail assembly responsive to movement of said carrier assembly.

8. A collapsable and extensible lift truck mast comprising: a first outer rail assembly adapted to be secured with said lift truck at a fixed vertical position; a second center rail assembly telescopically engaged in said first rail assembly and adapted to move vertically relative to said first rail assembly; a sheave assembly mounted along the lower portion of said second center rail assembly; a hydraulic ram assembly mounted on said second rail assembly and adapted to move upwardly and downwardly with said second rail assembly, said hydraulic ram assembly including an extendible piston rod; a sheave assembly on an upper end portion of said piston rod; a third inner rail assembly telescopically engaged in said second rail assembly and adapted to move vertically relative to said second rail assembly; a carrier assembly mounted for vertical movement along said third inner rail assembly; a sheave assembly secured on an upper end portion of said carrier assembly, a carriage assembly mounted for vertical movement along said third inner rail assembly; primary lift chain means secured at a first end with a lower end portion of said carrier assembly, extending over said sheave assembly on said piston rod, and secured at a second opposite end with said second center rail assembly for supporting said carrier assembly and raising and lowering said carrier assembly responsive to extension and retraction of said piston rod; a secondary lift chain means secured at a first end with said carriage assembly, extending over said sheave assembly on said carrier assembly, and connected at a second opposite end with said third inner rail assembly for raising and lowering said carriage assembly resonsive to vertical movement of said carrier assembly, said carriage assembly being raised and lowered at a four-to-one ratio relative to the vertical movement of said piston rod; tertiary chain means secured at a first end with said third inner rail assembly, extending under said sheave assembly on said second center rail assembly, and connected at an opposite second end with an upper end portion of said first outer rail assembly; and means included in said carrier assembly for engaging and supporting said third inner rail assembly by said carrier assembly for raising and lowering and supporting said third inner rail assembly with said carrier assembly when said carrier assembly is at an upper end position relative to said third inner rail assembly, said third inner rail assembly being raised and lowered at a four-to-one ratio relative to the vertical movement of said piston rod while said third inner rail assembly is engaged with said carrier assembly.

9. A mast for a lift truck in accordance with claim 8 including guide roller and guide channel means connected with said carrier assembly and with said third inner rail means for maintaining alignment of said carrier assembly within said third inner rail means as said carrier assembly is raised and lowered relative to said third inner rail means.

10. A mast for a lift truck in accordance with claim 9 including a hydraulic hose coupling assembly connected with said hydraulic ram assembly to supply hydraulic fluid under pressure to said ram assembly and means for raising and lowering said hydraulic hose assembly as said second center rail assembly is moved vertically in said first outer rail assembly.

11. A mast for a lift truck in accordance with claim 9 wherein said hydraulic ram assembly is a single stage unit having a single cylinder and a single piston rod movable therein.

12. A mast for a lift truck in accordance with claim 11 including guide means on said sheave assembly of said piston rod operably connected with said third inner rail assembly for maintaining the alignment of said piston rod and sheave assembly as said piston rod moves relative to said third rail assembly.

13. An extensible and collapsable mast for use with a lift truck to handle loads therewith comprising: a first outer rail assembly adapted to be secured with said lift truck and remain fixed vertically, said rail assembly including a cross brace along an upper back portion thereof; a second center rail assembly telescopically engaged in said first rail assembly and adapted to move vertically therein including a cross brace secured across the back face of the upper end portion thereof; stop means on said cross brace of said first rail assembly engageable by said cross brace on said second rail assembly for supporting said second rail assembly at a lower end position in said first rail assembly; a cradle assembly connected across a lower end portion of said second rail assembly; a hydraulic ram assembly supported at a lower end in said cradle assembly, said ram assembly including an extendible piston rod; a tertiary lift chain sheave mounted in said cradle assembly on each side of the base end of said hydraulic ram assembly; a primary lift chain sheave mounted on the head end of said piston rod on each side of said rod; a third inner rail assembly telescopically engaged in said second rail assembly and adapted to move vertically therein including a cross brace across the upper end thereof, an intermediate cross brace near the longitudinal midsection thereof, and a head cross brace near the lower end thereof including stop means on said lower cross brace for engagement with said cradle assembly of said second center rail assembly for supporting said third rail assembly at a lower end position in said second center rail assembly; a set of tertiary lift chains connected from said third inner rail assembly downwardly under said tertiary lift chain sheave on said cradle assembly and upwardly to said cross brace member at the upper end of said first rail assembly; guide channel means along the back face of said third inner rail assembly; a guide had connected with said piston rod at an upper end thereof for maintaining alignment of said rod and said sheaves thereon during vertical movement of said rod and said sheaves relative to said third inner rail assembly; a carrier frame assembly supported for vertical movement within in said third inner rail assembly along a front side of said hydraulic ram assembly; guide means between said carrier frame assembly and said third inner rail assembly for maintaining said carrier frame assembly in alignment as said assembly moves vertically within said third rail assembly; a secondary lift chain sheave on each side of said carrier frame assembly near an upper end thereof; a set of primary lift chains connected from a lower end of said carrier frame assembly over said primary lift chain sheaves on said piston rod to said third inner rail assembly; a load handling carriage secured for vertical movement along the front face of said third inner rail assembly in front of said carrier assembly; a set of secondary lift chains connected from said carriage assembly over said secondary lift chain sheaves on said carrier assembly to said third inner rail assembly; stop means at the upper end of said carrier frame assembly engageable with said cross brace member at the upper end of said thid inner rail assembly for supporting and lifting said third inner rail assembly when said carrier frame assembly reaches an upper end position within said third inner rail assembly; and hydraulic coupling means along a back face of said mast connected with said hydraulic ram assembly for communicating hydraulic fluid pressure from said lift truck to said ram assembly.

14. A mast for a lift truck in accordance with claim 13 including a guide channel means mounted within said third inner rail assembly for guiding the lower end of said carrier frame assembly, one end of said secondary lift chains being connected with an upper end of said guide channel means and one end of said tertiary lift chains being connected with the lower end of said guide channel means.

15. A mast for a lift truck in accordance with claim 14 wherein said hydraulic ram assembly is a single stage unit having a single cylinder and a single extendible piston rod and said lift chains are coupled between said hydraulic ram assembly, said first, second and third rail assemblies, said carrier assembly, and said carriage assembly to provide a four-to-one lift ratio between the movement of said carriage assembly and the movement of said hydraulic ram piston.

16. A mast for a lift truck in accordance with claim 15 wherein said secondary and said tertiary lift chains are interconnected with each other to provide a continuous integral lift chain connection from said carriage assembly over said lift chain sheave on said carrier assembly under said lift chain sheaves on said second center rail assembly to said cross brace member at the upper end of said first rail assembly.

* * * * *

UNITED STATES PATENT AND TRADEMARK OFFICE

CERTIFICATE OF CORRECTION

PATENT NO. : 4,051,970

DATED : October 4, 1977

INVENTOR(S) : Keith E. Ramsey

It is certified that error appears in the above-identified patent and that said Letters Patent are hereby corrected as shown below:

| | |
|---|---|
| Column 9, line 35 | after "4b" delete "other" and insert --of the--. |
| Column 9, line 68 | delete "pen" and insert --open--. |
| Column 12, line 63 | change "20" to --10--. |

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*